US010074529B2

(12) United States Patent
Collings et al.

(10) Patent No.: US 10,074,529 B2
(45) Date of Patent: Sep. 11, 2018

(54) DEVICE FOR IMPROVED DETECTION OF IONS IN MASS SPECTROMETRY

(71) Applicant: DH Technologies Development Pte. Ltd., Singapore (SG)

(72) Inventors: Bruce Andrew Collings, Bradford (CA); Pascal Martin, Woodbridge (CA); Stephen Bruce Locke, Ajax (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/544,020

(22) PCT Filed: Jan. 29, 2016

(86) PCT No.: PCT/IB2016/050482
§ 371 (c)(1),
(2) Date: Jul. 16, 2017

(87) PCT Pub. No.: WO2016/128855
PCT Pub. Date: Aug. 18, 2016

(65) Prior Publication Data

US 2018/0012744 A1 Jan. 11, 2018

Related U.S. Application Data

(60) Provisional application No. 62/116,354, filed on Feb. 13, 2015.

(51) Int. Cl.
*H01J 49/02* (2006.01)
*H01J 49/00* (2006.01)

(52) U.S. Cl.
CPC ..... *H01J 49/025* (2013.01); *H01J 49/0031* (2013.01)

(58) Field of Classification Search
CPC .. H01J 49/025; H01J 49/0027; H01J 49/0031; H01J 49/24; H01J 49/26; G01T 1/20; G01T 1/24
See application file for complete search history.

(56) References Cited

U.S. PATENT DOCUMENTS 6,025,590 A 2/2000 Itoi
7,119,333 B2 * 10/2006 Herschbein ..... H01J 37/244 250/309

(Continued)

FOREIGN PATENT DOCUMENTS

WO 2013098597 A1 7/2013

OTHER PUBLICATIONS

International Search Report and Written Opinion for PCT/IB2016/050482, dated May 17, 2016.

*Primary Examiner* — David E Smith
(74) *Attorney, Agent, or Firm* — John R. Kasha; Kelly L. Kasha; Kasha Law LLC

(57) ABSTRACT

An electron multiplier is positioned relative to at least one dynode to direct a beam of secondary particles from the at least one dynode to a collector area of the electron multiplier and not to a channel area of the electron multiplier for a range of electron multiplier voltages applied by one or more voltage sources to the electron multiplier and for a dynode voltage applied by the one or more voltage sources to the at least one dynode. The electron multiplier includes an aperture with an entrance cone and walls of the entrance cone comprise the collector area and an apex of the entrance cone comprises the channel area. An electron multiplier voltage of the range of electron multiplier voltages is applied to the electron multiplier and the dynode voltage is applied to the at least one dynode using the one or more voltage sources.

10 Claims, 32 Drawing Sheets

(56) References Cited

U.S. PATENT DOCUMENTS

| | | | | |
|---|---|---|---|---|
| 7,465,919 | B1 | 12/2008 | Hosea et al. | |
| 7,633,059 | B2 | 12/2009 | Russ, IV et al. | |
| 2002/0162959 | A1* | 11/2002 | Itoi | H01J 49/067 250/292 |
| 2010/0252729 | A1* | 10/2010 | Jolliffe | H01J 49/025 250/282 |
| 2015/0187550 | A1* | 7/2015 | Hirano | H01J 49/025 250/281 |

* cited by examiner

100

200

300

400

500

600

900

1000

1100

1300

1400

1500

1700

1800

1900

2100

2300

2500

2600

2700

2800

200

3200

DEVICE FOR IMPROVED DETECTION OF IONS IN MASS SPECTROMETRY

CROSS REFERENCE TO RELATED APPLICATION

This application claims the benefit of U.S. Provisional Patent Application Ser. No. 62/116,354, filed Feb. 13, 2015, the content of which is incorporated by reference herein in its entirety.

INTRODUCTION

In a conventional mass spectrometer, molecules of a sample are ionized in an ionization chamber, and ions produced there are separated by a mass filter with respect to mass-to-charge ratio (m/z). Then, some of the ions pass through the mass filter and enter an ion detector sub-system, which generates an electric signal having an intensity corresponding to the number of the ions that has entered. Thus, the intensity of the distribution of the detection signals with respect to m/z is obtained.

FIG. 2 is a cross-sectional side view 200 of an exemplary conventional ion detector sub-system receiving ions from a mass spectrometer. The ion detector sub-system includes an electron multiplier or detector 220 and optionally a conversion electrode or high energy dynode (HED) 210. Conventionally, the detector sub-system of FIG. 2 is operated in one of two ways. In a first method of operation, ions from aperture electrode 250 are sent directly to detector 220 along path 270. For negative ions (negative ion mode) detector 220 has a voltage that is more positive than the voltage of aperture electrode 250 in order to attract the negative ions to detector 220. For positive ions (positive ion mode) detector 220 has a voltage that is more negative than the voltage of aperture electrode 250 in order to attract the positive ions to detector 220. HED 210 is not needed in this direct mode of operation. However, a deflector (not shown) can be used to adjust the trajectories of negative or positive ions to provide a maximum gain.

In a second method of operation of the detector sub-system of FIG. 2, ions from aperture electrode 250 are indirectly detected by detector 220. Ions from aperture electrode 250 are first sent directly to HED 210 along path 280. Secondary particles from HED 210 are then sent to detector 220 along path 290 to be detected. This second method of operation also has two modes.

In negative ion mode, for example, negative ions pass through the space defined by quadrupoles 230 along axis 240 of the mass spectrometer and pass through the opening of aperture electrode 250. Voltages are applied to HED 210 and detector 220 establishing an electric field along axis 260.

In order to send secondary positive particles to detector 220, the voltage applied to HED 210 is more positive than the voltage applied to detector 220. The resulting electric field along axis 260, directs negative ions along path 280 from exit lens or aperture electrode 250 to HED 210. HED 210 converts the negative ions to secondary positive particles. The secondary positive particles are then directed by the electric field along path 290 to detector 220.

In positive ion mode, for example, positive ions also pass through the space defined by quadrupoles 230 along axis 240 of the mass spectrometer and pass through the opening of aperture electrode 250. Voltages are applied to HED 210 and detector 220 establishing an electric field along axis 260. In positive ion mode, the voltage applied to HED 210 is more negative than the voltage applied to detector 220. The resulting electric field along axis 260, however, directs positive ions along path 280 from exit lens or aperture electrode 250 to HED 210. HED 210 converts the positive ions to secondary electrons. The secondary electrons are then directed by the electric field along path 290 to detector 220.

Path 270 and paths 280 and 290 are just examples of many different paths negative and positive ions can follow. These paths vary based on the m/z values of the ions and the voltage difference between HED 210 and detector. Conventionally, however, ions are directed from aperture electrode 250 to any part of the conical area 225 of detector 220, or ions are directed from aperture electrode 250 to any part of the surface area 215 of HED 210 and, in turn, the secondary particles produced by HED 210 are directed to any part of the conical area 225 of detector 220.

FIG. 3 is a photograph showing a top view 300 of the conical area of an exemplary detector. The diameter of the conical area is 14 mm. At the center of the conical area is a circular area that is 3.5 mm in diameter. This circular area is where one or more electron multiplier channels are located. The detector depicted in FIG. 3 includes six channels. The circular area is hereinafter referred to as the channel area. The remainder of the conical areas is hereinafter referred to as the collector area.

FIG. 4 is a cross-sectional side view 400 of the conical area of an exemplary detector. The conical area includes walls or collector area 410, and channel area 420. Channel area 420 includes six channels. However, a detector can include one or more channels. The detector also includes cap 430 and mesh 440. Conventionally, positive ions, negative ions, secondary positive particles, or secondary electrons are directed to any part of the conical area including collector area 410 and channel area 420. Conventionally, it is thought that the performance of the detector is not dependent on the portion of the conical area that receives the positive ions, negative ions, secondary positive particles, or secondary electrons.

SUMMARY

A mass spectrometer detector sub-system is disclosed that directs ions directly from an exit lens of a mass spectrometer to the collector area of an electron multiplier and away from the channel area of the electron multiplier for a range of voltages that are applied to the electron multiplier. The mass spectrometer detector sub-system includes an electron multiplier and at least one voltage source.

The electron multiplier includes an aperture with an entrance cone. Walls of the entrance cone comprise a collector area and an apex of the entrance cone comprises a channel area.

The at least one voltage source applies an electron multiplier voltage of a range of electron multiplier voltages to the electron multiplier. The electron multiplier is positioned relative to an exit lens of a mass spectrometer to direct an ion beam directly from the exit lens to the collector area of the electron multiplier and not to the channel area of the electron multiplier for the range of electron multiplier voltages.

A method is disclosed for directing ions directly from an exit lens of a mass spectrometer to the collector area of an electron multiplier and away from the channel area of the electron multiplier for a range of voltages that are applied to the electron multiplier.

An electron multiplier is positioned relative to an exit lens of a mass spectrometer to direct an ion beam directly from the exit lens to a collector area of the electron multiplier and not to a channel area of the electron multiplier for a range of electron multiplier voltages applied by at least one voltage source to the electron multiplier. The electron multiplier includes an aperture with an entrance cone. Walls of the entrance cone comprise the collector area and an apex of the entrance cone comprises the channel area.

An electron multiplier voltage of the range of electron multiplier voltages is applied to the electron multiplier using the at least one voltage source.

A mass spectrometer detector sub-system is disclosed that directs secondary particles produced by a dynode to the collector area of an electron multiplier and away from the channel area of the electron multiplier for a range of voltages that are applied to the electron multiplier. The mass spectrometer detector sub-system includes an electron multiplier, at least one dynode, and one or more voltage sources.

The electron multiplier includes an aperture with an entrance cone. Walls of the entrance cone comprise a collector area and an apex of the entrance cone comprises a channel area. The one or more voltage sources apply an electron multiplier voltage of a range of electron multiplier voltages to the electron multiplier and a dynode voltage to the at least one dynode. The electron multiplier is positioned relative to the at least one dynode to direct a beam of secondary particles from the at least one dynode to the collector area of the electron multiplier and not to the channel area of the electron multiplier for the range of electron multiplier voltages applied by the one or more voltage sources to the electron multiplier and for the dynode voltage applied by the one or more voltage sources to the at least one dynode.

A method is disclosed for directing secondary particles produced by a dynode to the collector area of an electron multiplier and away from the channel area of the electron multiplier for a range of voltages that are applied to the electron multiplier.

An electron multiplier is positioned relative to at least one dynode to direct a beam of secondary particles from the at least one dynode to a collector area of the electron multiplier and not to a channel area of the electron multiplier for a range of electron multiplier voltages applied by one or more voltage sources to the electron multiplier and for a dynode voltage applied by the one or more voltage sources to the at least one dynode. The electron multiplier includes an aperture with an entrance cone. Walls of the entrance cone comprise the collector area and an apex of the entrance cone comprises the channel area.

An electron multiplier voltage of the range of electron multiplier voltages is applied to the electron multiplier and the dynode voltage is applied to the at least one dynode using the one or more voltage sources.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
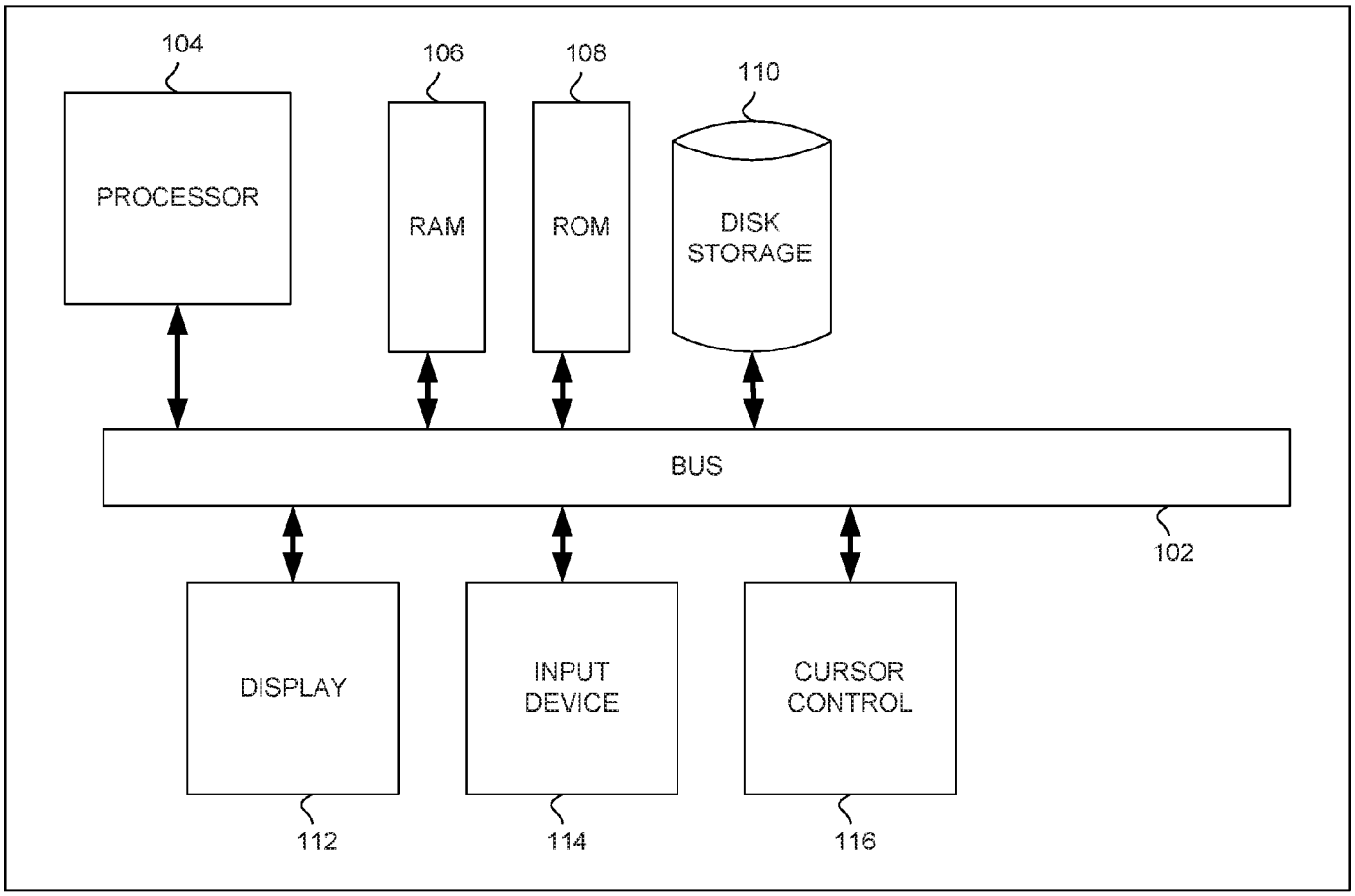
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110.

Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for Directing Ions and Particles

Figure 4:
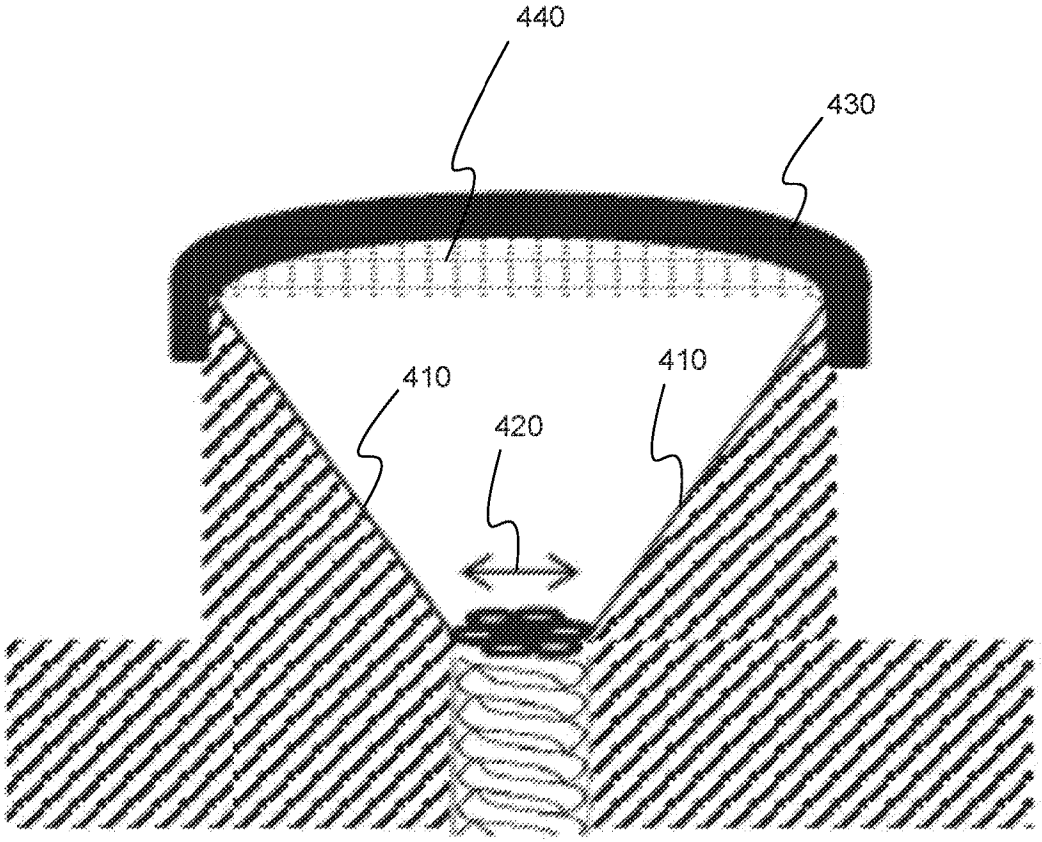
(PRIOR ART) FIG. 4
FIG. 4 is a cross-sectional side view of the conical area of an exemplary detector.

As described above with reference to FIG. 4, a typical detector of a mass spectrometer includes a conical area. This conical area, in turn, includes walls or collector area 410, and channel area 420. Channel area 420 is shown in FIG. 4 with six channels. However, a detector can include one or more channels. Conventionally, positive ions, negative ions, secondary positive particles, or secondary electrons are directed to any part of the conical area including collector area 410 and channel area 420. Conventionally, it is thought that performance of the detector is not dependent on portion of the conical area that receives the negative ions, secondary positive particles, or secondary electrons.

In various embodiments, the overall gain of a mass spectrometer detector is increased by directing positive ions, negative ions, secondary positive particles, or secondary electrons only to the collector area of a detector, collector area 410 of FIG. 4, for example. In other words, the performance of mass spectrometer detector is improved by preventing negative ions, secondary positive particles, or secondary electrons from impacting the channel area of channel area 420 of FIG. 4, for example.

Also, in various embodiments overall performance of a detector sub-system is enhanced by sending negative ions directly to a detector in negative ion mode and by sending positive ions to an HED in positive ion mode. Performance is improved, because HEDs generally have a poor conversion efficiency for small negative ions.

Figure 2:
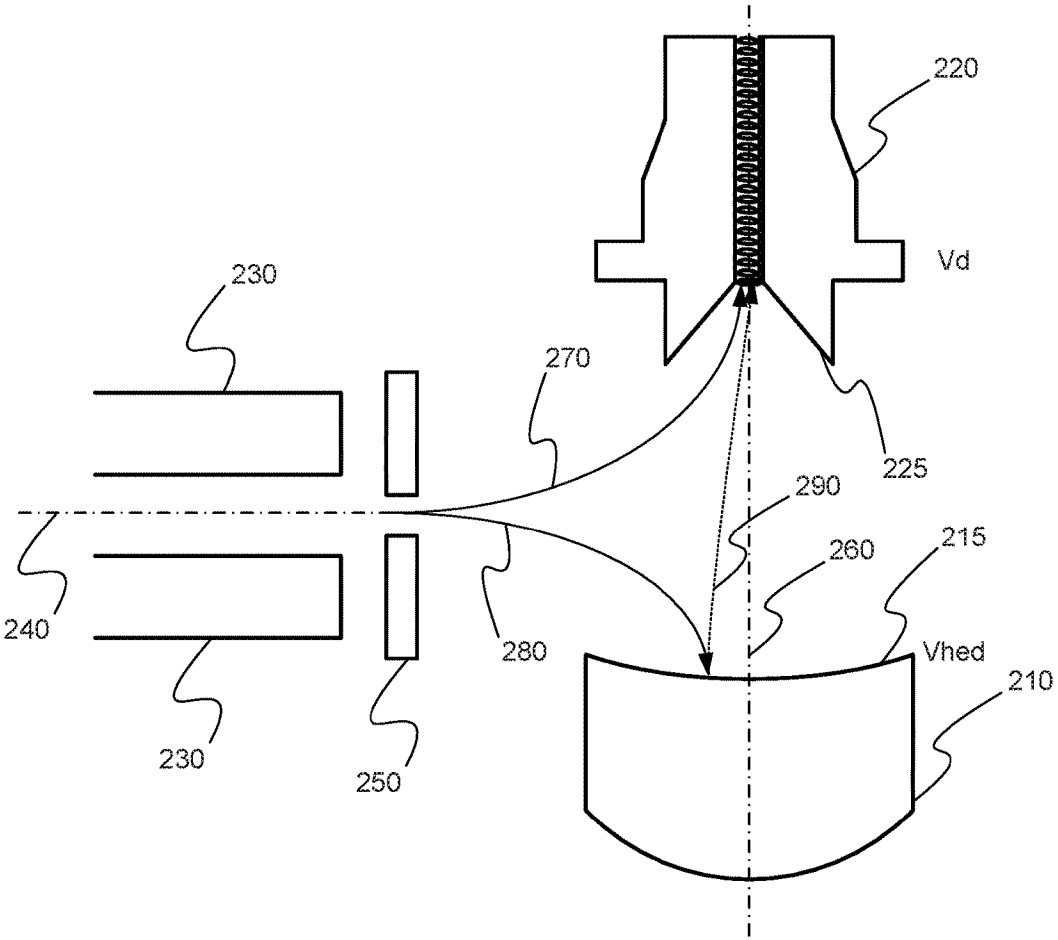
(PRIOR ART) FIG. 2
FIG. 2 is a cross-sectional side view of an exemplary conventional ion detector sub-system receiving ions from a mass spectrometer.

In regard to improving performance by directing particles to the collector area of a detector, when the field strength between a high energy dynode (HED), such as HED 210 of FIG. 2, and a detector, such as detector 220 of FIG. 2, changes, the focal point of the ions on the HED shifts causing the particles (electrons for positive ions, small positive particles for negative ions) that are produced at the HED to also shift where they strike within the entrance cone, or collector area of the detector. It is hypothesized that if the focal point of the particles at the detector is too close to the apex of the detector entrance cone then sub-optimal detector gains are experienced. The result is a lower than expected sensitivity for the detection system. Another hypothesis is that a low open area ratio causes the problem. The open area ratio is the ratio of the channel diameter to the solid area between the channels. If a particle hits the area between the channels then it is not detected, resulting in lower than expected sensitivity for the detection system.

Based upon experimental observations of an ions' signal intensity as a function of the potential applied to the HED, in conjunction with ion trajectory simulations using a Simion model of the detection system, it is apparent that the overall detector gain resulting from electrons (positive ion mode) striking at or near the apex of the detector entrance cone is not optimal. It is also apparent that allowing the electrons to strike further up the wall of the entrance cone allows for a better dispersion of the secondary electrons, produced from the initial impact of the incoming electrons, across the apex of the detector's entrance cone. Note that secondary electrons and secondary particles are described throughout this application. Generally, primary particles are the ions received by a detector sub-system. Secondary particles, secondary electrons, or secondary positive particles are particles derived from the primary particles. Secondary particles can include tertiary or even later particles derived or converted from the primary particles or other secondary particles.

Figure 3:
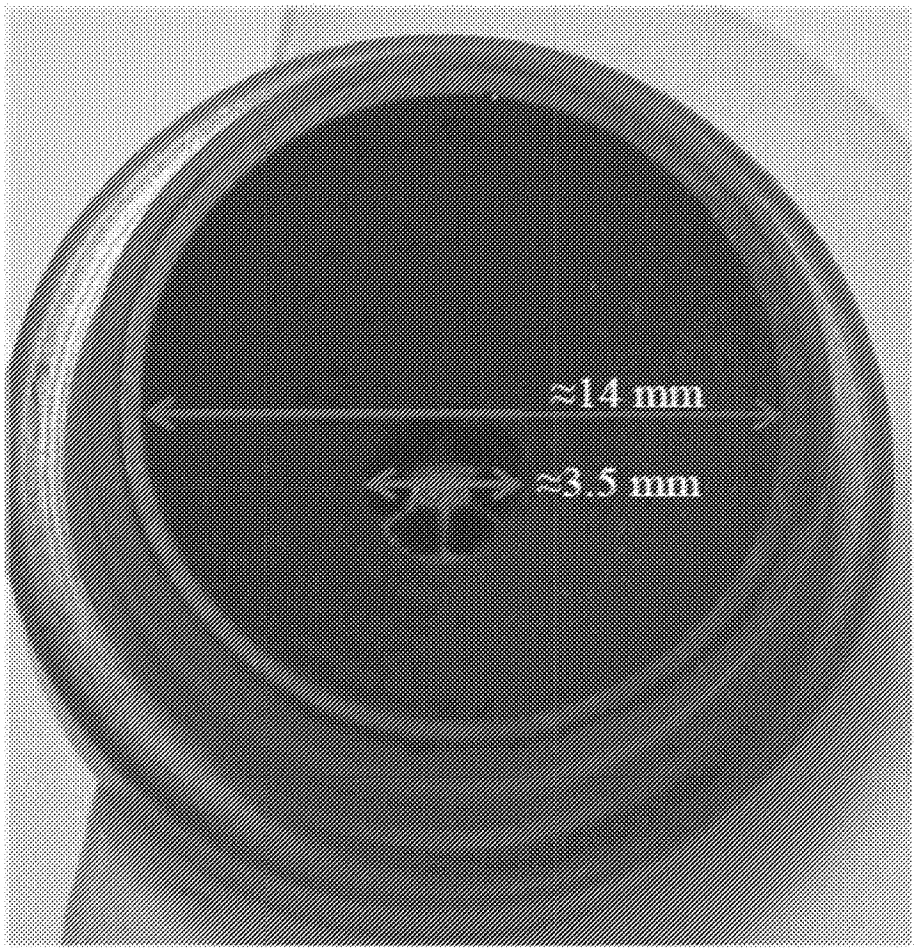
(PRIOR ART) FIG. 3
FIG. 3 is a photograph showing a top view of the conical area of an exemplary detector.

FIG. 3 is a photograph of the entrance cone, or conical area, of the 5903 Magnum detector without the cap and mesh over the entrance. This detector uses six channels twisted about a solid core. The six channels take up an area about 3.5 mm in diameter at the apex, or channel area, of the entrance cone. It is suspected that electrons striking within this region do not lead to optimal detector gains. This may be a result of the small size of the incoming electron beam not accessing all six channels or other factors, such as the open area ratio as described above.

Figure 5:
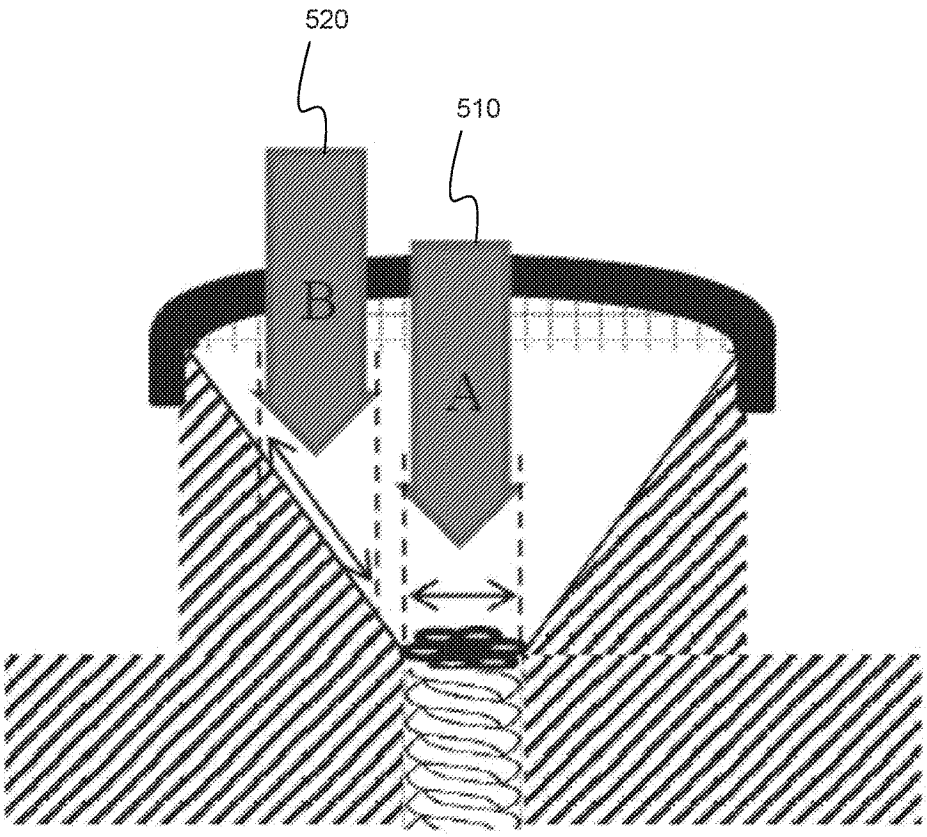
FIG. 5 is a cross-sectional side view of the conical area of an exemplary detector showing two different locations for an incoming particle beam, in accordance with various embodiments.

FIG. 5 is a cross-sectional side view 500 of the conical area of an exemplary detector showing two different locations for an incoming particle beam, in accordance with various embodiments. The particle beam can include positive ions, negative ions, secondary positive particles, or secondary electrons. In order to improve the performance of the detector, the incoming particle beam is moved from location 510 to location 520. Moving the particle beam to location 520 (on the collector area) may allow the particles to cascade over the six channels of the channel area, for example.

Figure 6:
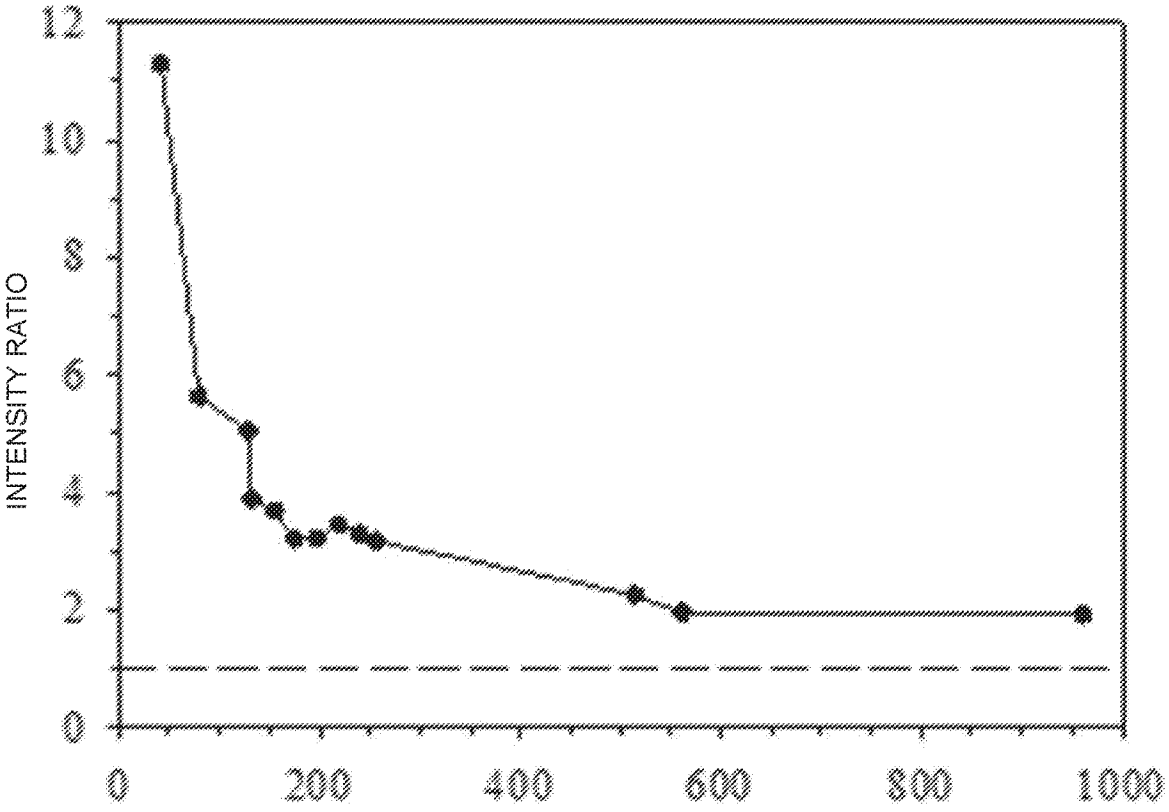
FIG. 6 is a plot of the ratio of signal intensities of direct detection and indirect detection of negative ions versus m/z, in accordance with various embodiments.

In regard to improving performance by sending negative ions directly to a detector in negative ion mode, FIG. 6 is instructive. FIG. 6 is a plot 600 of the ratio of signal intensities of direct detection and indirect detection of negative ions versus m/z, in accordance with various embodiments. In FIG. 6, ratios of the signal intensities for negative ions detected directly in the detector versus striking the HED and being converted into small positive particles which are then detected by the detector are plotted. Plot 600 shows that there is a significant improvement in detection efficiency, especially for masses below about m/z 200. This has to do with the poor conversion efficiency of small negative ions into small positive particles when the HED is impacted. It is, therefore, preferable to detect the negative ions directly for improved performance.

To detect the negative ions directly the detector is floated to a positive potential with enough potential (≥3 kV) that upon impact with the detector surface secondary electrons are produced efficiently. For this reason the detector is set to a float (voltage potential) of +5.5 kV, for example. The maximum float is typically limited by the onset of electronic noise and the precautions necessary when dealing with high voltages which include power supply limitations, creepage, etc.

In various embodiments, and in contrast to conventional methods, positive ions are then indirectly detected using an HED. Positive ions are not detected directly, because switching of the detector float potential takes too much time, typically 50 ms or more. Polarity switching of the detector float potential is also problematic when using a transimpedance amplifier. It is preferable to keep the detector float potential the same for both polarities and simply switch the potential applied to the HED. This can be done quickly (≈5 ms or less) and is separate from the detector amplifier circuitry so the transimpedance amplifier is not impacted. Another reason for detecting positive ions indirectly is that the conversion efficiency of high mass ions increases with impact energy at the HED's surface. It is significantly easier to increase the potential applied to the HED than it would be to increase the float potential of the detector. With the HED, the potential is applied to a piece of metal while with the detector there is the associated circuitry to be considered.

Shifting Relative Positions

In various embodiments, in order to shift the location where secondary positive particles or secondary electrons strike the entrance cone of a detector, the relative positions of the HED and the detector are changed. In other words, the HED can be shifted with respect to the detector, or the detector can be shifted with respect to the HED.

Figure 7:
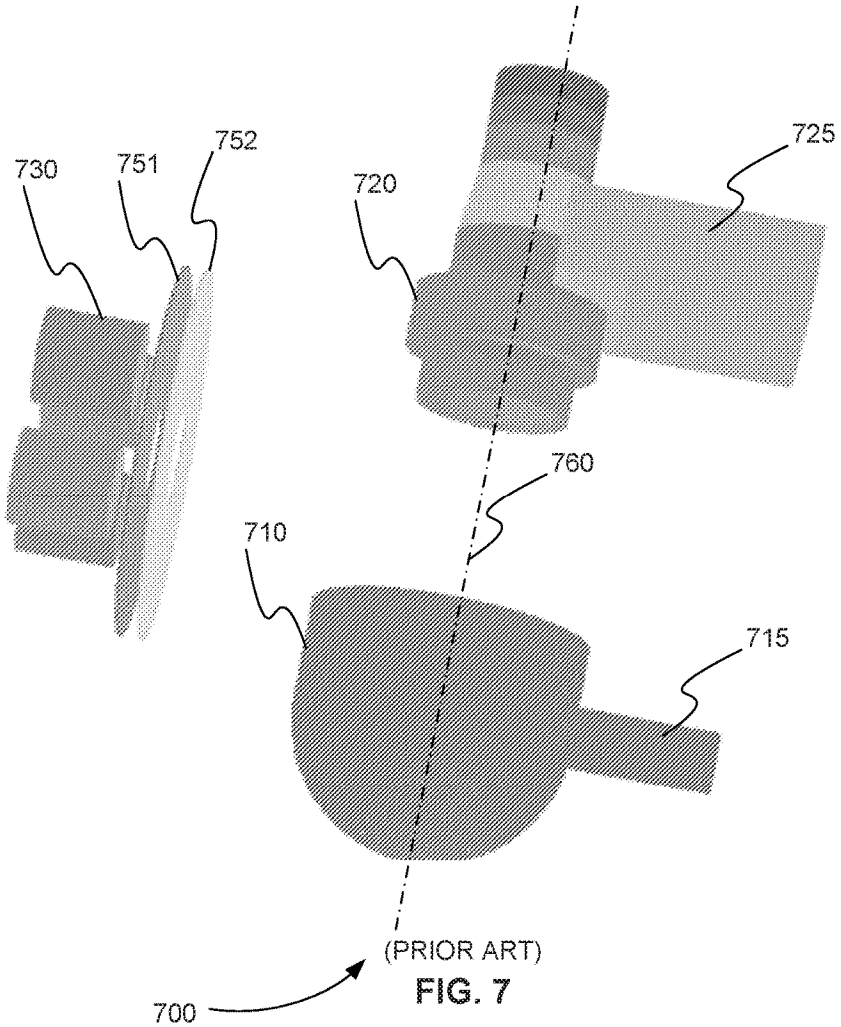
(PRIOR ART) FIG. 7
FIG. 7 is a three-dimensional view of the detector sub-system of a mass spectrometer where the positions of a high energy dynode (HED) and a detector are not shifted relative to one another.

FIG. 7 is a three-dimensional view 700 of the detector sub-system of a mass spectrometer where the positions of HED 710 and detector 720 are not shifted relative to one another. Detector sub-system includes HED 710 and detector 720. HED 710 includes HED mount 715. Detector 720 includes detector mount 725. The detector sub-system receives ions from quadrupole 730 of a mass spectrometer, for example. The ions exit quadrupole 730 through first exit lens, or aperture electrode, 751 and second exit lens, or aperture electrode, 752, for example. HED 710 and detector 720 share axis 760. In other words, HED 710 and detector 720 are not shifted relative to one another.

The potential applied to HED 710 is −15 kV, for example, to provide increased conversion efficiency of high mass positive ions into electrons leading to sensitivity gains. Gains for small positive particles are minimal, since the conversion efficiency at the HED is already approaching unity. In the case of a floated detection sub-system, negative ions are detected by guiding the ions directly into detector 720, while using the HED 710 as a deflector. This is accomplished by floating detector 720 to a high positive potential, i.e., +5.5 kV. When the polarity is switched from negative ion mode to positive ion mode the float potential is kept at +5.5 kV, which means that the potential applied to the HED is the only high potential in the detection system that needs to be switched. This preserves the high speed polarity switching capabilities of the system. This also means that the floated detection system has a potential difference of 20.5 kV between the HED (−15 kV) and detector entrance (+5.5 kV). In comparison, some other exemplary sub-systems of mass spectrometers have the entrance of the detector held at the bias potential of −1.5 kV, for example, while the HED is held at −10 kV for a potential difference of only 8.5 kV.

Figure 8:
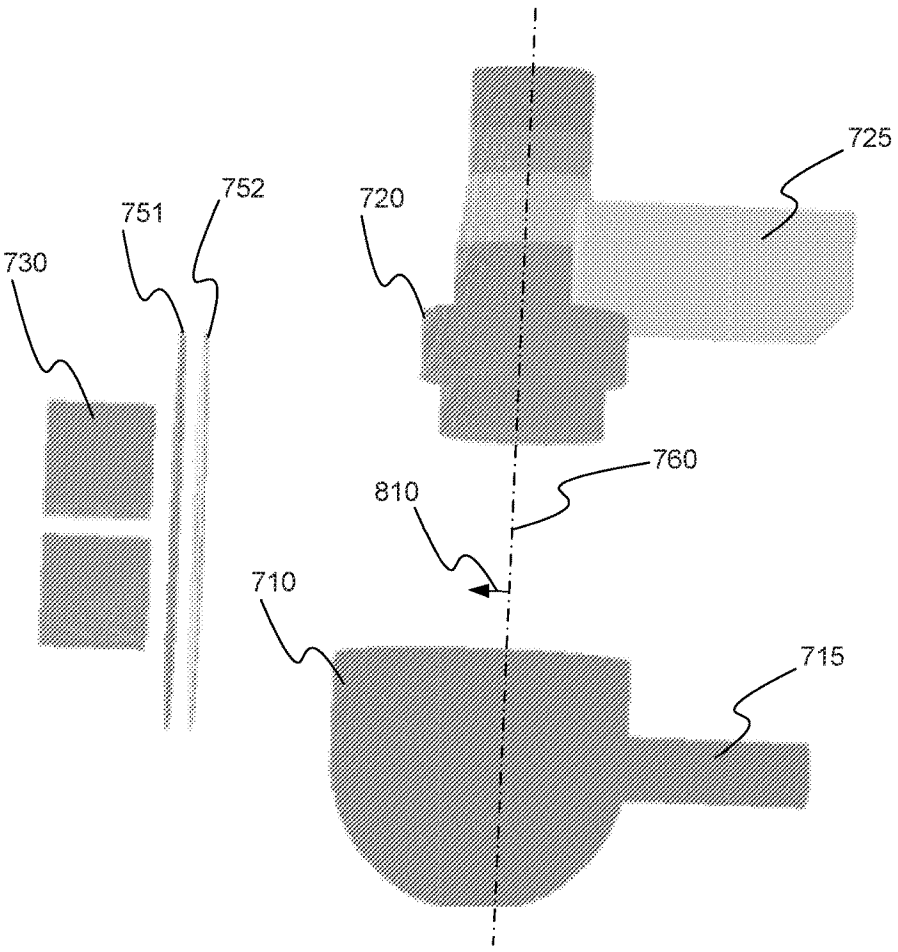
FIG. 8 is a three-dimensional view of the detector sub-system of the mass spectrometer of FIG. 7 where the position of the HED is shifted with respect to the detector, in accordance with various embodiments.

FIG. 8 is a three-dimensional view 800 of the detector sub-system of the mass spectrometer of FIG. 7 where the position of HED 710 is shifted with respect to detector 720, in accordance with various embodiments. HED 710 is shifted, for example, 3 mm towards exit lens 752. Shift 810 depicts the movement of HED 710 relative to formerly shared axis 760. Detector 720 remains on axis 760, but HED is now shifted from axis 760 by shift 810. If in FIG. 7 HED 710 is 16 mm from exit lens 752, in FIG. 8 HED 710 is now 13 mm from exit lens 752, for example.

Shifting Relative Positions Experimental Data

Figure 9:
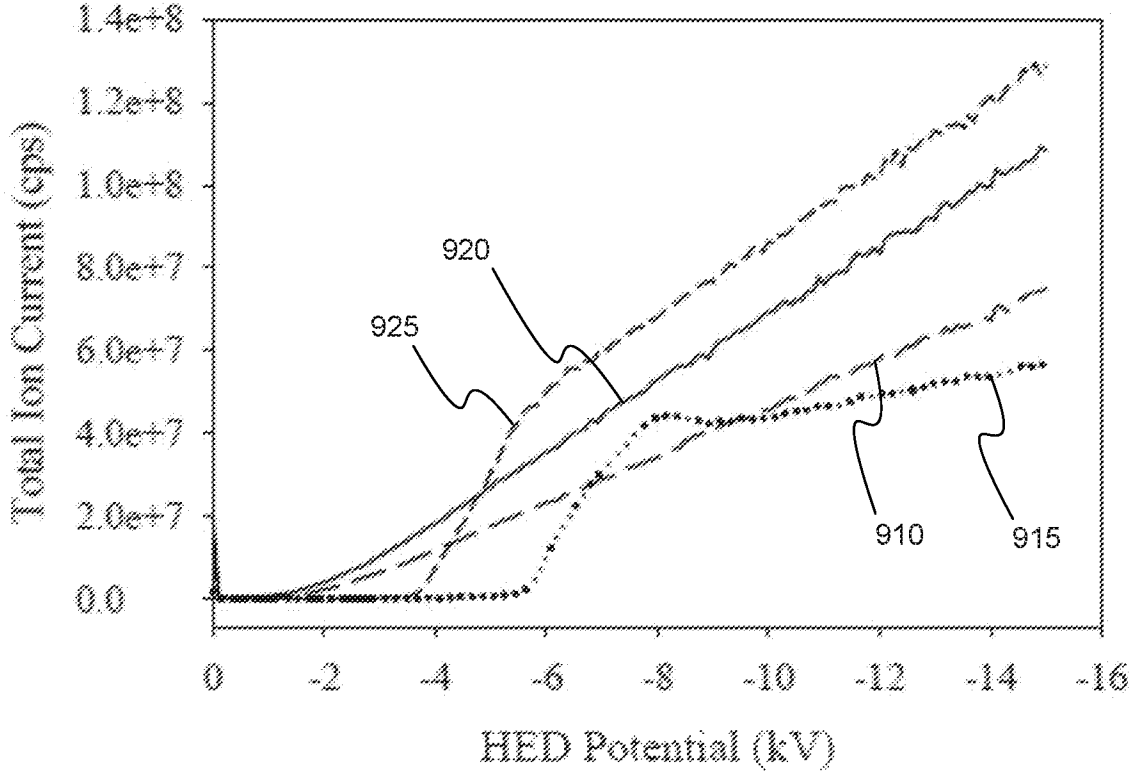
FIG. 9 is a plot of total ion current (TIC) versus HED potential for four exemplary experiments that show the effect of shifting the position of an HED with respect to a detector, in accordance with various embodiments.

FIG. 9 is a plot 900 of total ion current (TIC) versus HED potential for four exemplary experiments that show the effect of shifting the position of an HED with respect to a detector, in accordance with various embodiments. In each of the four experiments, an isotopic cluster from a solution of polypropylene glycol (PPG) is analyzed. The first isotope of the cluster has a mass-to-charge ratio (m/z) of 906.7, with a range between 904 and 910 encompassing the additional isotopes. The following peaks are at m/z 907.7, 908.7, etc.

In the first two experiments, the positions of the HED and detector are not shifted relative to one another, as shown, for example, in FIG. 7. The detector potential, however, is different in the two experiments. Data points 915 show how the TIC varies with HED potential when there is no shift in the relative positions of the HED and detector and when the detector float or potential is +5.5 kV. Data points 910 show how the TIC varies with HED potential when there is no shift in the relative positions of the HED and detector and when the detector potential is 0 kV.

In the final two experiments, the position of the HED is shifted 3 mm, as shown in FIG. 8, relative to the detector. The detector potential is also varied between the two final experiments. Data points 925 show how the TIC varies with HED potential when there is a 3 mm shift in the relative positions of the HED and detector and when the detector float or potential is +5.5 kV. Data points 920 show how the TIC varies with HED potential when there is a 3 mm shift in the relative positions of the HED and detector and when the detector potential is 0 kV.

A comparison of data points 910 and 915 shows that there is a problem with a conventional detection sub-system, where the positions of the HED and detector are not shifted relative to one another. The detector potential for the experiment producing data points 910 is 0 kV, and the detector potential for the experiment producing data points 915 is +5.5 kV. It is expected that the conversion of positive ions into secondary particles at the HED is independent of the detector potential. The conversion efficiency is dependent upon the kinetic energy of the positive ion striking the HED. It is expected that the slopes of lines 915 and 910 should be similar, beyond HED potentials greater than about −7 kV, but they are not, an indication of a problem at the detector.

Plot 900 shows that shifting the position of the HED 3 mm relative to the detector removes this effect. A comparison of data points 920 and 925 shows that after the HED reaches a certain negative potential (here about −5.5 kV) the slope of data points 925 are similar to the slope of data points 920.

Plot 900 also shows that shifting the position of the HED 3 mm relative to the detector also provides for an overall gain in signal intensity or TIC. For example, the experiment producing data points 910 and the experiment producing data points 920 both have a detector voltage of 0 kV. However, the TIC of data points 920 is consistently higher than the TIC of data points 910. Because the HED is shifted in the experiment producing data points 920 and it is not in the experiment producing data points 910, this indicates that shifting the HED increases the TIC.

Similarly, data points 915 and data points 925 can be compared. The TIC of data points 925 is consistently higher than the TIC of data points 915. Because the HED is shifted in the experiment producing data points 925 and it is not in the experiment producing data points 915, this also indicates that shifting the HED increases the TIC.

Table 1 further quantifies the improvement in TIC gained by shifting the position of the HED 3 mm relative to the detector. The percent increase shown in Table 1 is the percent increase in TIC in going from an HED potential of −10 kV to −15 kV.

TABLE 1

| Experiment | TIC for m/z 907 HED at −10 kV | TIC for m/z 907 HED at −15 kV | Percent Increase in TIC |
|---|---|---|---|
| No Shift, Detector at 0 kV | 3.5e6 | 5.8e6 | 66 |
| No Shift, Detector at +5.5 kV | 3.4e6 | 4.4e6 | 29 |
| 3 mm Shift, Detector at 0 kV | 5.5e6 | 8.9e6 | 62 |
| 3 mm Shift, Detector at +5.5 kV | 6.9e6 | 1.0e7 | 51 |

Figure 10:
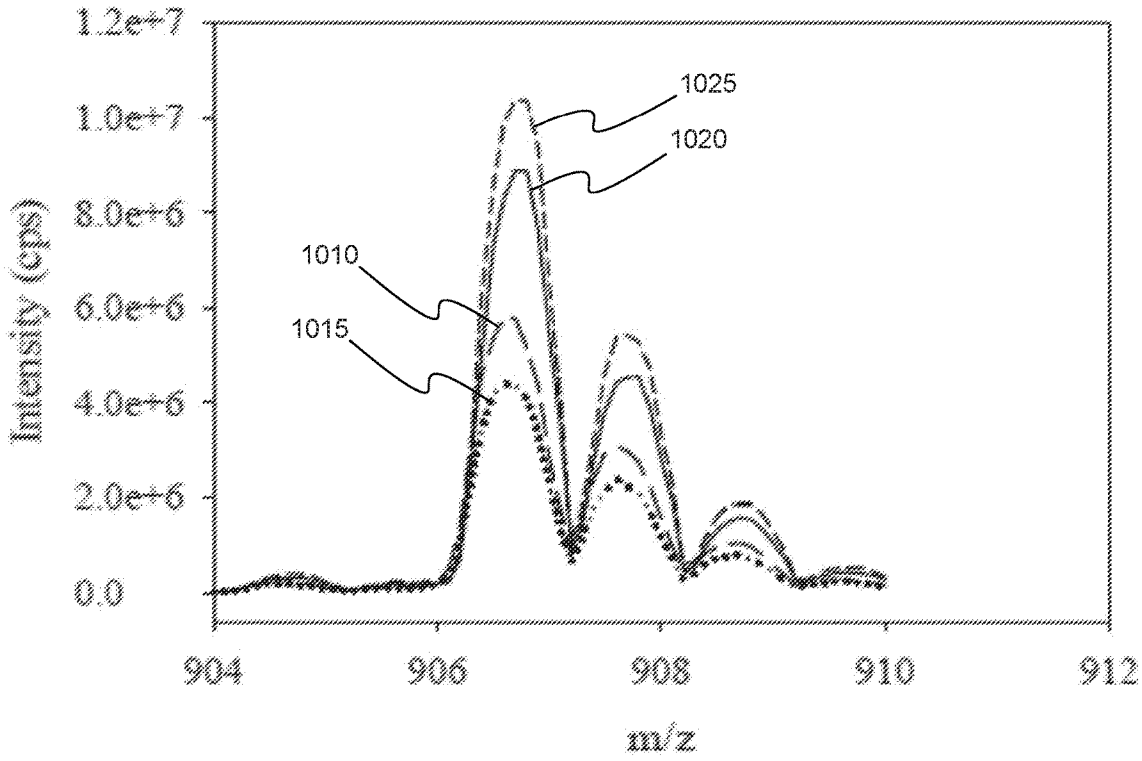
FIG. 10 is a plot of intensity versus m/z for the same four exemplary experiments described with respect to FIG. 9, in accordance with various embodiments.

FIG. 10 is a plot 1000 of intensity versus m/z for the same four exemplary experiments described with respect to FIG. 9, in accordance with various embodiments. In each of the four experiments, an isotopic cluster (m/z 906.7) from a solution of polypropylene glycol (PPG) is analyzed. The intensities for the isotopic cluster from the four experiments are plotted for an m/z range between 1004 and 1010. The intensities are for an HED potential of −15 kV.

Data points 1015 show the intensities for the isotopic cluster when there is no shift in the relative positions of the HED and detector and when the detector float or potential is +5.5 kV. Data points 1010 show the intensities for the isotopic cluster when there is no shift in the relative positions of the HED and detector and when the detector potential is 0 kV. Data points 1025 show the intensities for the isotopic cluster when there is a 3 mm shift in the relative positions of the HED and detector and when the detector float or potential is +5.5 kV. Data points 1020 show the intensities for the isotopic cluster when there is a 3 mm shift in the relative positions of the HED and detector and when the detector potential is 0 kV.

Plot 1000 shows that shifting the position of the HED 3 mm relative to the detector also provides higher peak intensities for the isotopic cluster. For example, the experiment producing data points 1010 and the experiment producing data points 1020 both have a detector voltage of 0 kV. However, data points 1020 produce higher peaks for the isotopic cluster than data points 1010. Because the HED is shifted in the experiment producing data points 1020 and it is not in the experiment producing data points 1010, this indicates that shifting the HED provides higher peak intensities for the isotopic cluster.

Similarly, data points 1015 and data points 1025 can be compared. Data points 1025 produce higher peaks for the isotopic cluster than data points 1015. Because the HED is shifted in the experiment producing data points 1025 and it is not in the experiment producing data points 1015, this also indicates that shifting the HED increases the TIC.

Shifting Relative Positions Simulation Data

The detector sub-system of FIG. 7 can also be simulated using Simion, for example. In the detector sub-system of FIG. 7 the positions of HED 710 and detector 720 are not shifted relative to one another. In simulations of FIG. 7, a last 10 mm of the mass analyzing third quadrupole (Q3) 730, a gridded exit lens 751, a non-gridded second exit lens 752, a detector mount 725 along with a gridded detector 720 and an HED 710 are included. The exit of detector 720 is given a potential 2 kV positive relative to the entrance of detector 720. This represents a bias potential of 2 kV. Table 2 shows the potentials and a few other parameters used in the simulations of FIG. 7.

TABLE 2

| | |
|---|---|
| Mathieu q | 0.7 |
| Number of Ions | 500 |
| Initial Distribution | 3D Gaussian, 0.5 mm std dev |
| Ion Energy (towards exit lens) | 1.5 eV |

TABLE 2-continued

| | |
|---|---|
| Drive Frequency (kHz) | 1.228 MHz |
| Field Radius | 4.09 mm |
| Rod Radius | 4.75 mm |
| Fraction of A-pole rf on exit lens | 0.5 |

| Optic | Potential (at Float = 0 kV) | Potential (at Float = +5.5 kV) |
|---|---|---|
| Quadrupole Offset | −30 V | −30 V |
| Exit Lens | −200 V | −200 V |
| 2nd Exit Lens | 0 V | 0 V |
| Detector and Detector Mount | 0 kV | +5.5 kV |
| HED | −15 kV | −15 kV |

Figure 11:
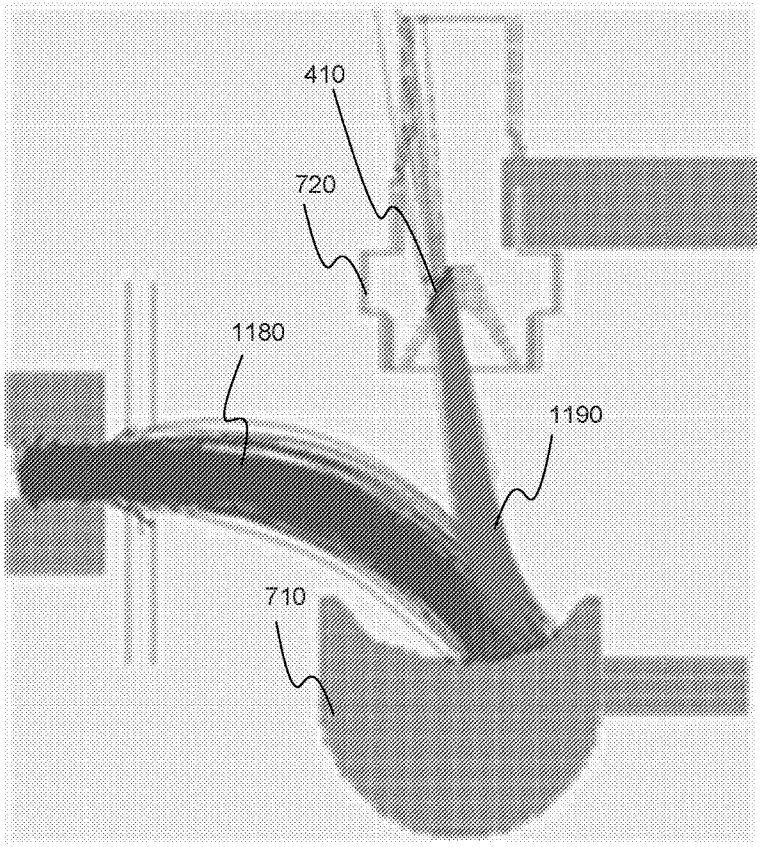
FIG. 11 is a side view of simulated ion trajectories in positive ion mode produced by simulating the detector sub-system of FIG. 7 for positive ions with an m/z of 907 and for a detector potential of 0 kV, in accordance with various embodiments.

FIG. 11 is a side view 1100 of simulated ion trajectories in positive ion mode produced by simulating the detector sub-system of FIG. 7 for positive ions with an m/z of 907 and for a detector potential of 0 kV, in accordance with various embodiments. FIG. 11 shows that positive ions 1180 with an m/z of 907 are directed to HED 710. HED 710 then produces secondary electrons 1190 that are directed to detector 720. The detector potential of 0 kV and the HED potential of −15 kV, as shown in Table 2, produce an electric field that directs positive ions 1180 and secondary electrons 1190. FIG. 11 shows that this electric field directs secondary electrons 1190 to collector area 410 of the entrance cone of detector 720.

As a result, the performance or signal gain of the detector is not reduced.

Figure 12:
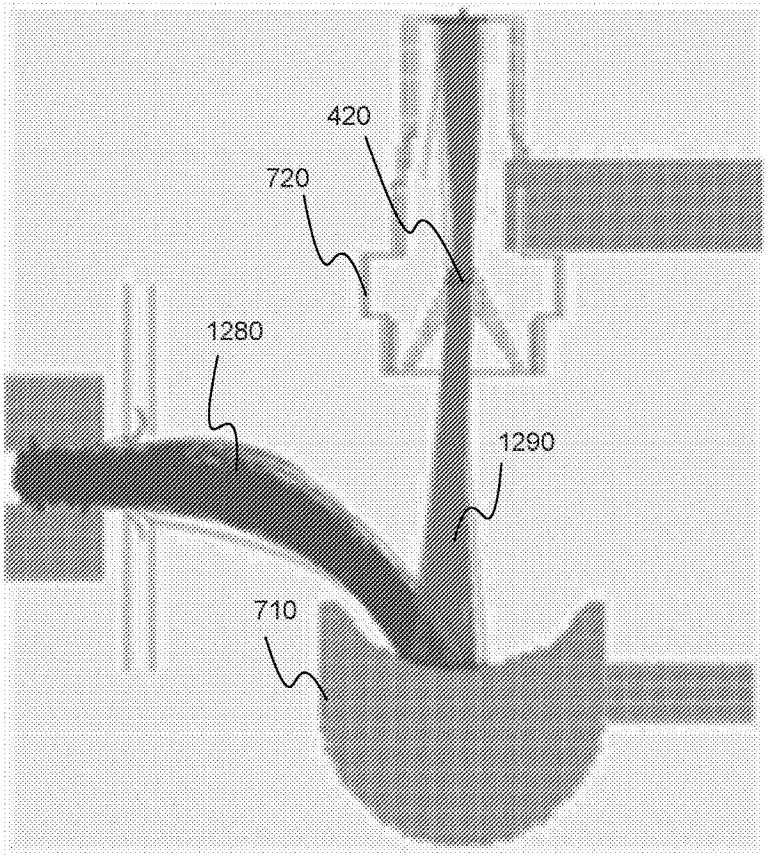
FIG. 12 is a side view of simulated ion trajectories in positive ion mode produced by simulating the detector sub-system of FIG. 7 for positive ions with an m/z of 907 and for a detector potential of +5.5 kV, in accordance with various embodiments.

FIG. 12 is a side view 1200 of simulated ion trajectories in positive ion mode produced by simulating the detector sub-system of FIG. 7 for positive ions with an m/z of 907 and for a detector potential of +5.5 kV, in accordance with various embodiments. FIG. 12 shows that positive ions 1280 with an m/z of 907 are directed to HED 710. HED 710 then produces secondary electrons 1290 that are directed to detector 720. The detector potential of +5.5 kV and the HED potential of −15 kV, as shown in Table 2, produce an electric field that directs positive ions 1280 and secondary electrons 1290. FIG. 12 shows that this electric field now directs secondary electrons 1290 to channel area 420 of the entrance cone of detector 720.

FIG. 12 shows that when the detector potential is +5.5 kV, ions with an m/z of 907 are primarily directed to the channel area of the entrance cone of the detector. As a result, the performance or signal gain of the detector is reduced. The spread in the ion trajectories for an m/z of 907 in FIGS. 11 and 12 is a result of the radio frequency (RF) voltages applied to the quadrupole rods and to the exit lens of the mass spectrometer.

Figure 13:
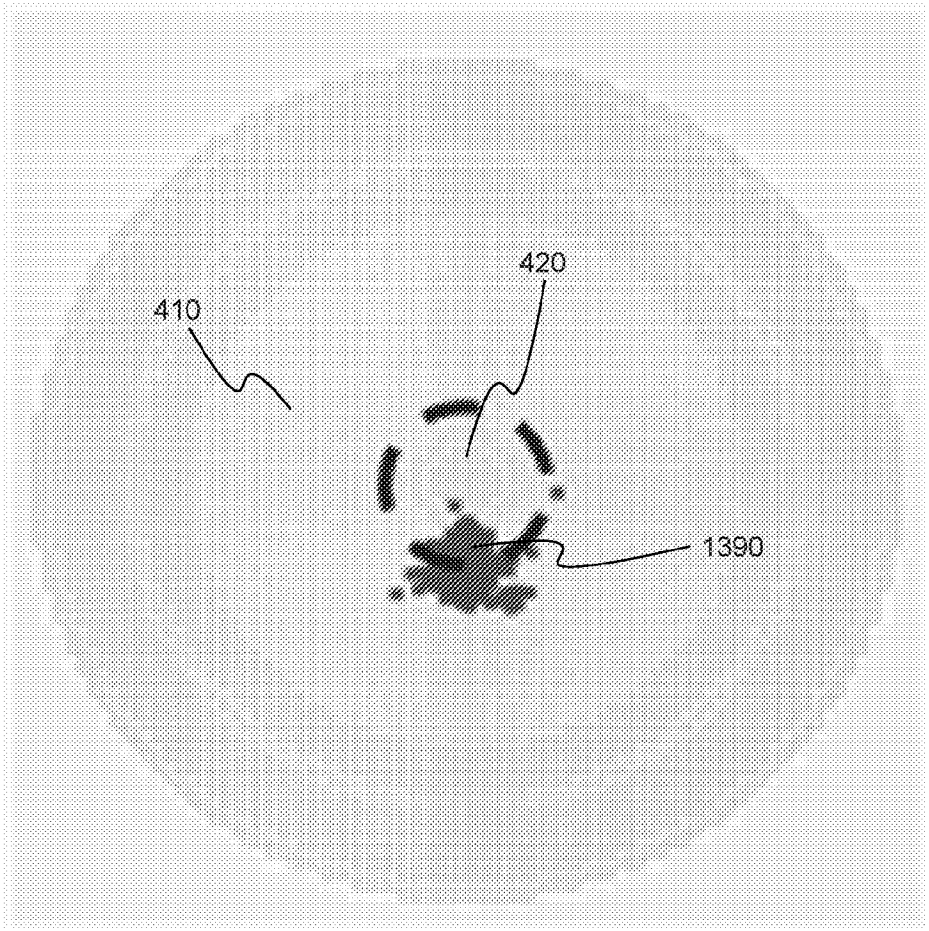
FIG. 13 is a view down into an entrance cone of a detector showing simulated termination points of ion trajectories in positive ion mode produced by simulating the detector sub-system of FIG. 7 for positive ions with an m/z of 907 and for a detector potential of 0 kV, in accordance with various embodiments.

FIG. 13 is a view 1300 down into an entrance cone of a detector showing simulated ion trajectories in positive ion mode produced by simulating the detector sub-system of FIG. 7 for positive ions with an m/z of 907 and for a detector potential of 0 kV, in accordance with various embodiments. FIG. 13 shows secondary electrons 1390 produced from positive ions with an m/z of 907 are directed primarily to collector area 410 of the entrance cone and not to channel area 420. A minimal amount hits the channel area. So there will be some reduction in signal. This shows up as the difference between curve 910 and 920 in FIG. 9. If all the ions were hitting collector area 410 then it would be expected that curve 910 and curve 920 would be identical.

Like FIG. 11, FIG. 13 shows that when the detector potential is 0 kV, ions with an m/z of 907 are directed primarily to the collector area of the entrance cone of the detector and not to the channel area of the detector. As a result, the performance or signal gain of the detector is not reduced.

Figure 14:
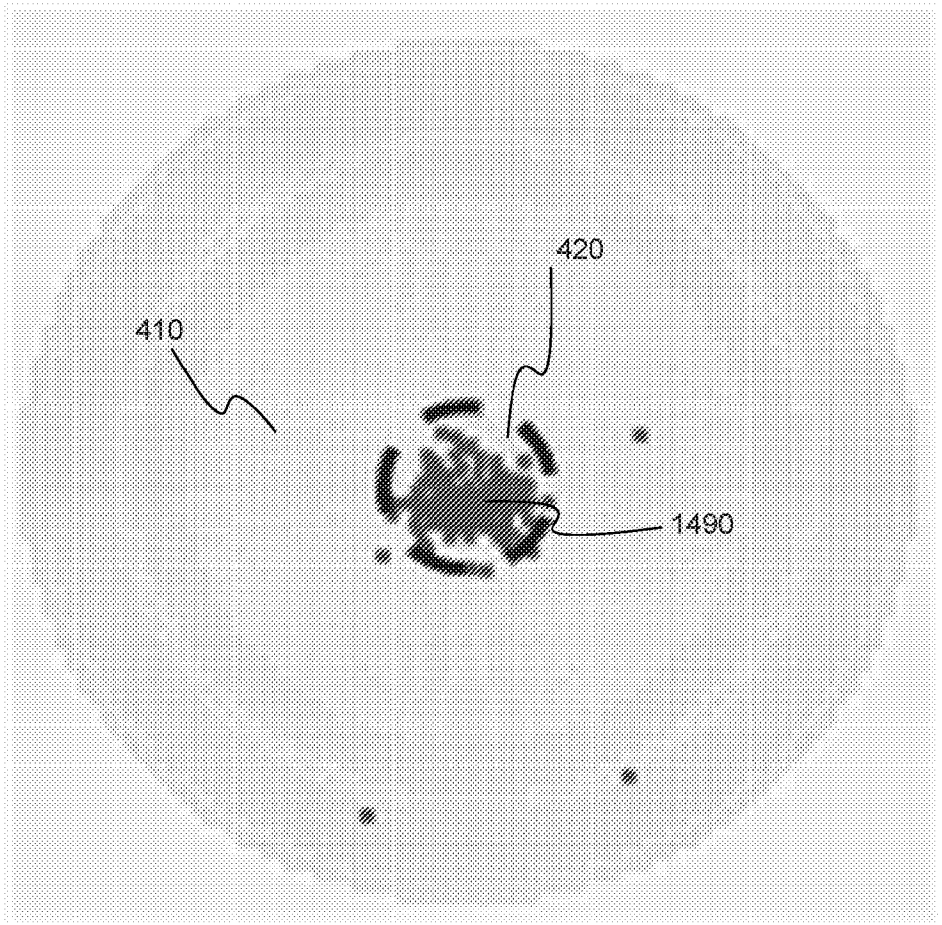
FIG. 14 is a view down into an entrance cone of a detector showing simulated termination points of ion trajectories in positive ion mode produced by simulating the detector sub-system of FIG. 7 for positive ions with an m/z of 907 and for a detector potential of +5.5 kV, in accordance with various embodiments.

FIG. 14 is a view 1400 down into an entrance cone of a detector showing simulated ion trajectories in positive ion mode produced by simulating the detector sub-system of FIG. 7 for positive ions with an m/z of 907 and for a detector potential of +5.5 kV, in accordance with various embodiments. FIG. 14 shows secondary electrons 1490 produced from positive ions with an m/z of 907 are now directed primarily to channel area 420 of the entrance cone and not to collector area 410.

Like FIG. 12, FIG. 14 shows that when the detector potential is +5.5 kV, ions with an m/z of both 907 are primarily directed to the channel area of the entrance cone of the detector. As a result, the performance or signal gain of the detector is reduced.

FIGS. 11 through 14 show that when the positions of the HED and the detector are not shifted relative to one another, as shown in FIG. 7, a certain voltage difference between the HED and the detector can cause the ion trajectories to be directed primarily to the channel area of the detector. This reduces the overall performance of the detector.

In FIG. 8, the position of the HED is shifted with respect to detector. This causes the ion trajectories to be directed primarily to the collector area of the detector even when the voltage difference between the HED and the detector is increased. The HED is, for example, shifted 3 mm with respect to detector in FIG. 8.

The question of how much should the HED be shifted depends on the aperture of the detector entrance cone. In the case of the Magnum 5903 with the cap and mesh the inner diameter of the cap is 13.2 mm (radius=6.6 mm). The diameter of the channel area comprising the six channels at the apex of the detector entrance cone is roughly 3.5 mm (radius=1.75 mm). To move the particle beam to a point halfway between the edge of the cap and the channels requires that the particle beam be shifted (6.6 mm+1.75 mm)/2=4.18 mm. What is unknown is the starting location of the electron beam. Experimentally, shifting the HED 3 mm with respect to the detector keeps the beam primarily on the collector area and not on the channel area for detector potentials of 0 kV and +5.5 kV. However, other shift distances may be possible.

Knowledge of the diameter of the particle beam and the location that the particle beam strikes the detector, before the HED is shifted, is required before the HED can be shifted to accurately place the particle beam at a point along the detector surface. Without that knowledge the optimum location may be found through the use of experimental methods. A determination can also be made through the use of simulations.

Figure 15:
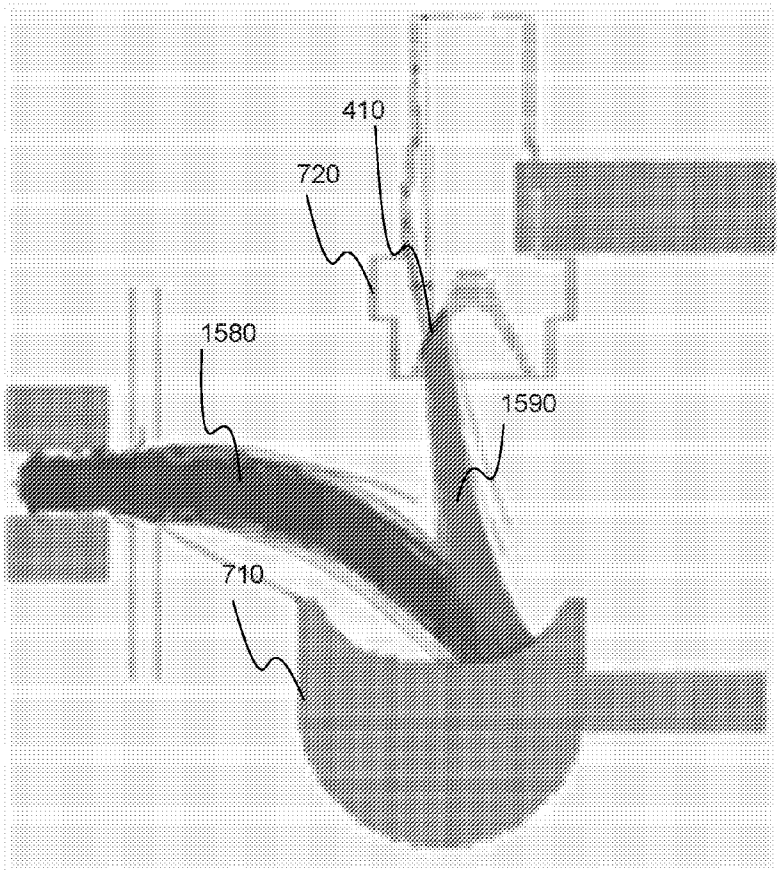
FIG. 15 is a side view of simulated ion trajectories in positive ion mode produced by simulating the detector sub-system of FIG. 8 for positive ions with an m/z of 907 and for a detector potential of 0 kV, in accordance with various embodiments.

FIG. 15 is a side view 1500 of simulated ion trajectories in positive ion mode produced by simulating the detector sub-system of FIG. 8 for positive ions with an m/z of 907 and for a detector potential of 0 kV, in accordance with various embodiments. FIG. 15 shows that positive ions 1580 with an m/z of 907 are directed to HED 710. HED 710 then produces secondary electrons 1590 that are directed to detector 720. The detector potential of 0 kV and the HED potential of −15 kV, as shown in Table 2, produce an electric field that directs positive ions 1580 and secondary electrons 1590. FIG. 15 shows that this electric field directs secondary electrons 1590 to collector area 410 of the entrance cone of detector 720.

FIG. 15 shows that when the detector potential is 0 kV, ions with an m/z of 907 are directed primarily to the collector area of the entrance cone of the detector and not to the channel area of the detector. As a result, the performance or signal gain of the detector is not reduced.

Figure 16:
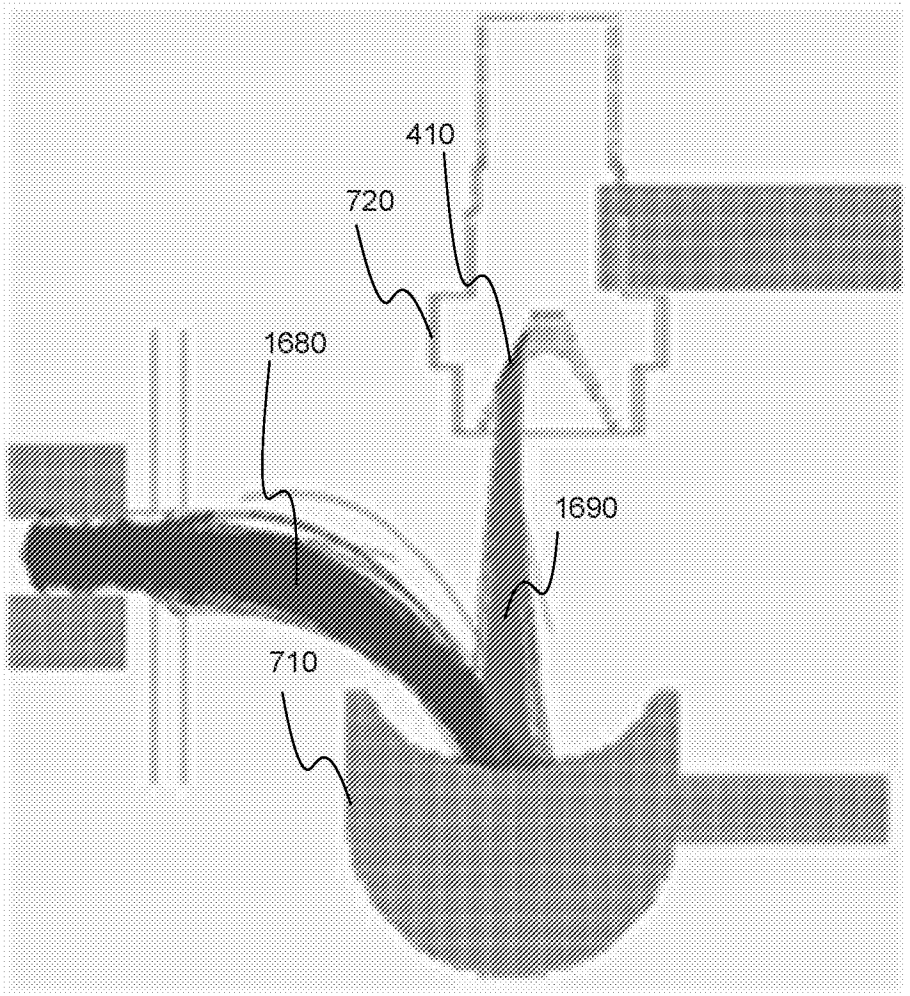
FIG. 16 is a side view of simulated ion trajectories in positive ion mode produced by simulating the detector sub-system of FIG. 8 for positive ions with an m/z of 907 and for a detector potential of +5.5 kV, in accordance with various embodiments.

FIG. 16 is a side view 1600 of simulated ion trajectories in positive ion mode produced by simulating the detector sub-system of FIG. 8 for positive ions with an m/z of 907 and for a detector potential of +5.5 kV, in accordance with various embodiments. FIG. 16 shows that positive ions 1680 with an m/z of 907 are directed to HED 710. HED 710 then produces secondary electrons 1690 that are directed to detector 720. The detector potential of +5.5 kV and the HED potential of −15 kV, as shown in Table 2, produce an electric field that directs positive ions 1680 and secondary electrons 1690. FIG. 16 shows that this electric field still directs secondary electrons 1690 to collector area 410 of the entrance cone of detector 720.

In contrast to FIG. 12, FIG. 16 shows that when the detector potential is +5.5 kV, ions with an m/z of 907 are primarily still directed to the collector area of the entrance cone of the detector. As a result, the performance or signal gain of the detector is not reduced. Consequently, shifting the HED relative to the detector is shown to improve the overall performance.

Figure 17:
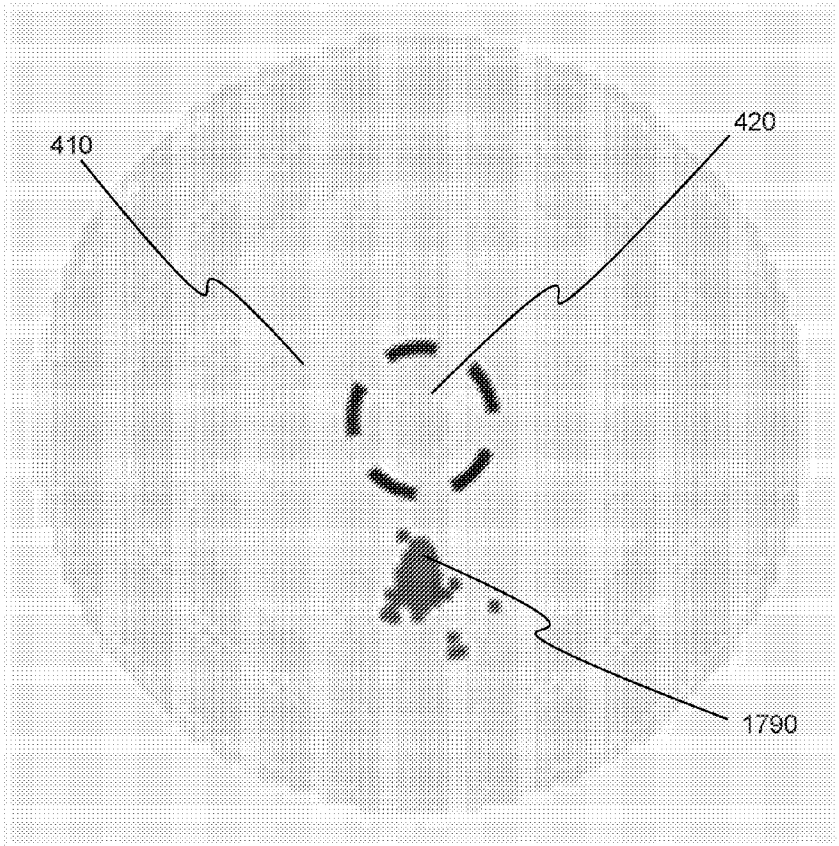
FIG. 17 is a view down into an entrance cone of a detector showing simulated termination points of ion trajectories in positive ion mode produced by simulating the detector sub-system of FIG. 8 for positive ions with an m/z of 907 and for a detector potential of 0 kV, in accordance with various embodiments.

FIG. 17 is a view 1700 down into an entrance cone of a detector showing simulated ion trajectories in positive ion mode produced by simulating the detector sub-system of FIG. 8 for positive ions with an m/z of 907 and for a detector potential of 0 kV, in accordance with various embodiments. FIG. 17 shows secondary electrons 1790 produced from positive ions with an m/z of 907 are directed primarily to collector area 410 of the entrance cone and not to channel area 420.

Like FIG. 15, FIG. 17 shows that when the detector potential is 0 kV, ions with an m/z of 907 are directed primarily to the collector area of the entrance cone of the detector and not to the channel area of the detector. As a result, the performance or signal gain of the detector is not reduced.

Figure 18:
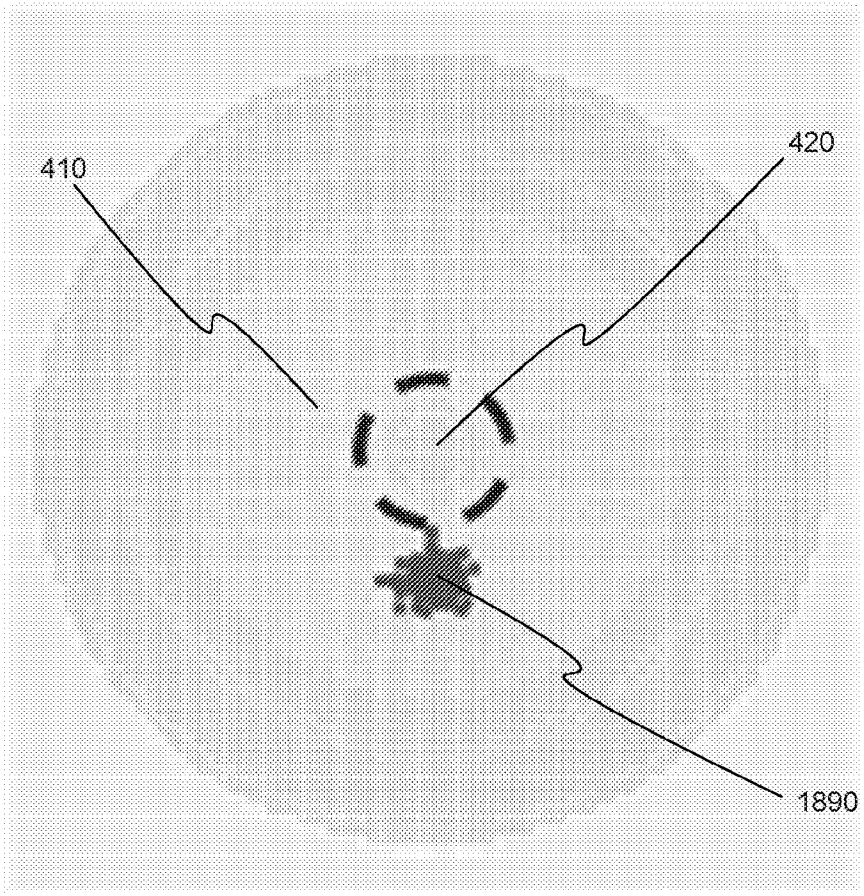
FIG. 18 is a view down into an entrance cone of a detector showing simulated termination points of ion trajectories in positive ion mode produced by simulating the detector sub-system of FIG. 8 for positive ions with an m/z of 907 and for a detector potential of +5.5 kV, in accordance with various embodiments.

FIG. 18 is a view 1800 down into an entrance cone of a detector showing simulated ion trajectories in positive ion mode produced by simulating the detector sub-system of FIG. 8 for positive ions with an m/z of 907 and for a detector potential of +5.5 kV, in accordance with various embodiments. FIG. 18 shows secondary electrons 1890 produced from positive ions with an m/z of 907 are still directed primarily to collector area 410 of the entrance cone and not to channel area 420.

In contrast to FIG. 14, FIG. 18 shows that when the detector potential is +5.5 kV, ions with an m/z of 907 are primarily still directed to the collector area of the entrance cone of the detector. As a result, the performance or signal gain of the detector is not reduced. Consequently, shifting the HED relative to the detector is shown to improve the overall performance.

FIGS. 15-18 all relate to shifting the HED relative to the detector as shown in FIG. 8. Similar results, however, can be expected if instead the detector is shifted relative to the HED.

In various embodiments, shifting the relative positions of the HED and the detector improves the performance of the detector sub-system for a range of voltages. FIGS. 13 and 14 show detector impact areas when the HED and the detector are not shifted relative to one another. FIG. 13 shows that for a detector voltage of 0 kV, electrons from the HED are only partially striking channel area 420 (area within the dashed circle). Increasing the voltage to +5.5 kV, as shown in FIG. 14, deflects the electron beam even more into channel area 420. This is undesirable. It is desirable, however, to increase the detector voltage in order to gain the advantage of detecting negative ions directly, thus improving low mass sensitivity over sending the ions directly to the HED first, as described above.

Figure 19:
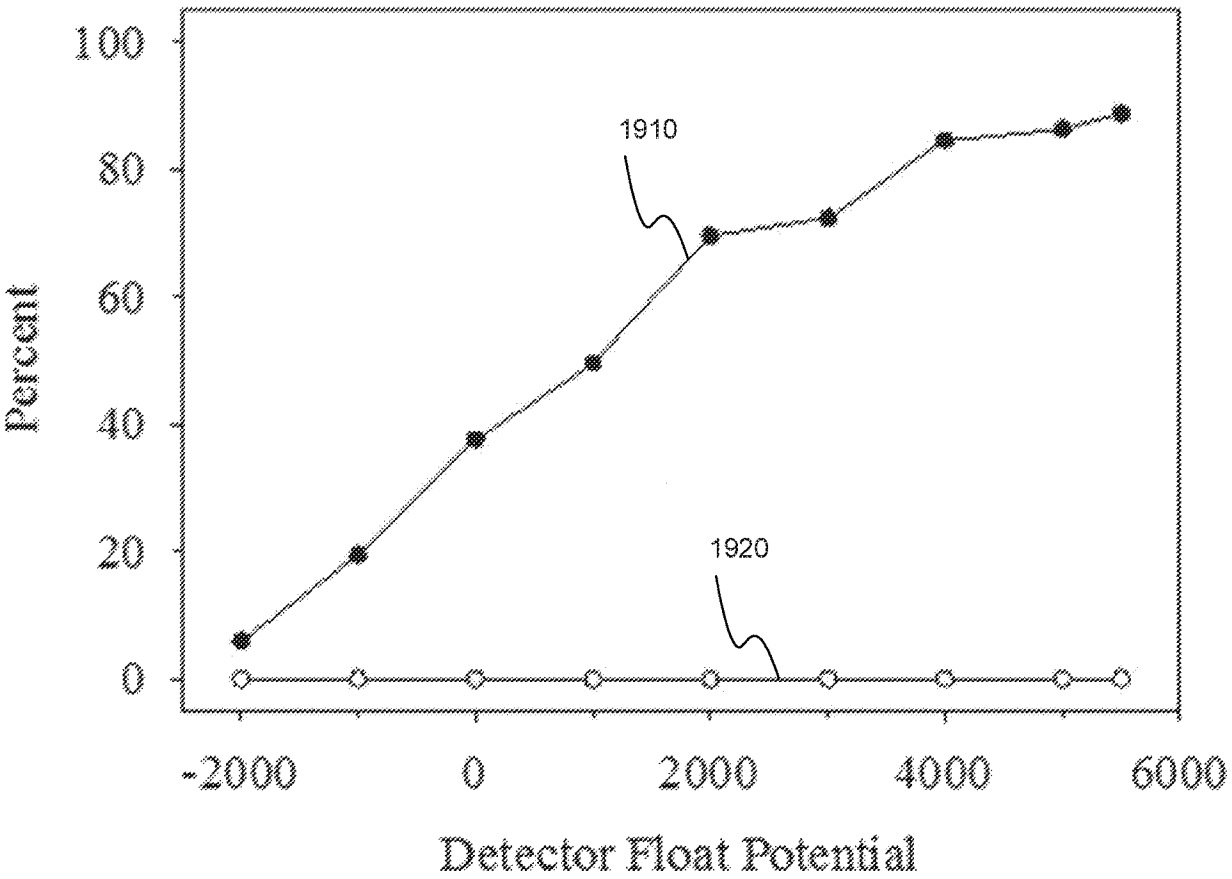
FIG. 19 is a plot of the percentage of secondary electron impacts with the channel area versus detector voltage showing the results for the detector sub-system of FIG. 8 (no shift in positions of HED and detector) and the detector sub-system of FIG. 8 (positions of HED and detector shifted by 3 mm), in accordance with various embodiments.

FIG. 19 is a plot 1900 of the percentage of secondary electron impacts with the channel area versus detector voltage showing the results for the detector sub-system of FIG. 7 (no shift in positions of HED and detector) and the detector sub-system of FIG. 8 (positions of HED and detector shifted by 3 mm), in accordance with various embodiments. Data points 1910 show that for the detector sub-system of FIG. 7 (no shift in positions of HED and detector) the fraction of impacts that are within the channel area of the detector increases as the float potential is increased. Data points 1920 shows that when the HED is shifted by 3 mm, as in relation to the detector sub-system of FIG. 8, the number of impacts that lie within the channel area drops to zero at all the float potentials simulated.

As a result, in various embodiments, the detector sub-system of FIG. 8 is used to detect negative ions by receiving them directly from the exit aperture of the quadrupole and to detect positive ions indirectly by receiving secondary electrons from the HED, produced from the positive ions impacting the HED. The ion energy of the negative ions is, for example, 2 keV or greater. The detector voltage for both positive and negative ions is greater than or equal to +2 kV. This means that the detector is floated to +2 kV or greater relative to the quadrupole offset. (Gains are poor at 2 kV or less for ions going directly to the detector.) The potential applied to the HED determines if an ion is guided to the detector or to the HED. In contrast, conventionally a detector is either kept at ground potential or at a bias potential (which is a negative kV).

FIGS. 15-16 depict simulated positive ion and secondary electron trajectories for the detector sub-system of FIG. 8 operating in positive ion mode. The detector sub-system of FIG. 8 can also be operated in negative ion mode. As described above, in negative ion mode, voltages can be applied to the HED and the detector to either send negative ions directly to the detector or to send secondary positive particles to the detector.

In order to send negative ions directly to the detector, the voltage applied to the HED is made more negative than the voltage applied to the detector. For simulations of sending the negative ions directly to the detector, the detector potential is set to +5.5 kV and the HED potential is set to 0 kV.

Figure 20:
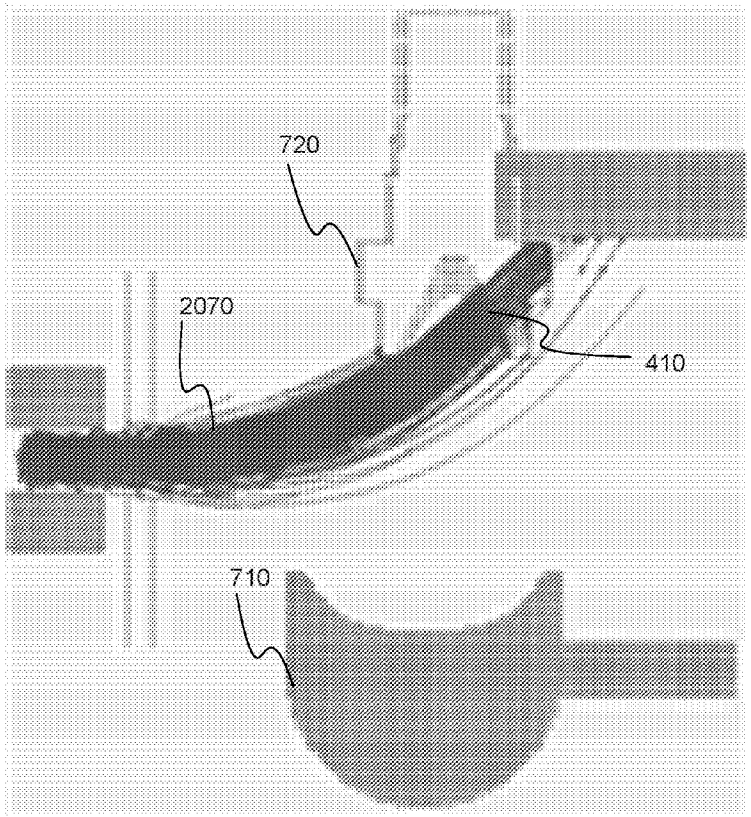
FIG. 20 is a side view of the trajectories of simulated negative ions with an m/z of 933 sent directly to the detector produced by simulating the detector sub-system of FIG. 8 in negative ion mode, in accordance with various embodiments.

FIG. 20 is a side view 2000 of the trajectories of simulated negative ions with an m/z of 933 sent directly to the detector produced by simulating the detector sub-system of FIG. 8 in negative ion mode, in accordance with various embodiments. FIG. 20 shows that negative ions 2070 with an m/z of 933 are directed directly to detector 720. The detector potential of +5.5 kV and the HED potential of 0 kV produce an electric field that directs negative ions 2070. FIG. 20 shows that this electric field directs negative ions 2070 to collector area 410 of the entrance cone of detector 720.

FIG. 20 shows that when the detector potential is +5.5 kV and the HED potential is 0 kV, negative ions with an m/z of 933 are primarily directed to the collector area of the entrance cone of the detector. As a result, the performance or signal gain of the detector is not reduced. Consequently, changing the potential of the HED to 0 kV is shown to improve the overall performance in negative ion mode where the negative ions are sent directly to the detector.

In order to send secondary positive particles to the detector in negative ion mode, the voltage applied to the HED is made more positive than the voltage applied to the detector. For simulations of sending secondary positive particles to the detector, the detector potential is set to 0 kV and the HED potential is set to +15 kV.

Note that at low masses (<m/z 200) the efficiency of producing small positive particles drops significantly (decreasing as the mass decreases) leading to reduced sensitivity. Also note that a mesh or grid placed over the detector entrance improves performance. Small positive particles striking the detector cone produce electrons. A fraction of the electrons produced, at the locations within the detector cone see a field pointing towards the HED. The overall result is a loss in sensitivity. Placing a grid over the detector entrance ensures that the electrons produced in the cone of the detector will follow the field that now takes the electrons towards the channels of the detector.

Figure 21:
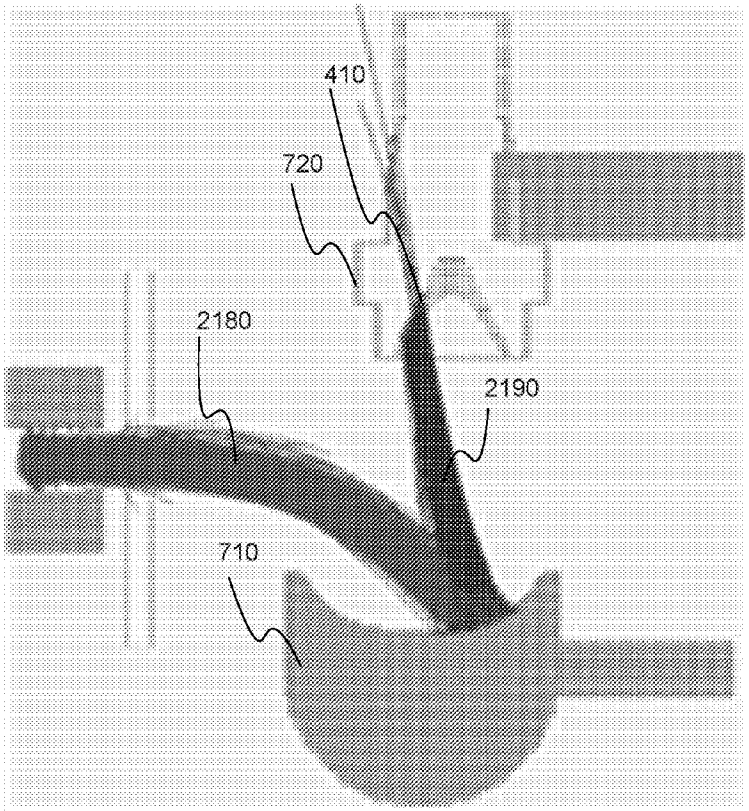
FIG. 21 is a side view of the trajectories of simulated negative ions with an m/z of 933 sent to the HED and secondary positive particles sent in response to the detector produced by simulating the detector sub-system of FIG. 8 in negative ion mode, in accordance with various embodiments.

FIG. 21 is a side view 2100 of the trajectories of simulated negative ions with an m/z of 933 sent to the HED and secondary positive particles sent in response to the detector produced by simulating the detector sub-system of FIG. 8 in negative ion mode, in accordance with various embodiments. FIG. 21 shows that negative ions 2180 with an m/z of 933 are directed to HED 710. HED 710 then produces secondary positive particles 2190 that are directed to detector 720. The detector potential of 0 kV and the HED potential of +15 kV produce an electric field that directs negative ions 2180 and secondary positive particles 2190. FIG. 21 shows that this electric field directs secondary positive particles 2190 to collector area 410 of the entrance cone of detector 720.

FIG. 21 shows that when the detector potential is set to 0 kV and the HED potential is set to +15 kV, secondary positive particles produced by the HED from negative ions with an m/z of 933 are primarily directed to the collector area of the entrance cone of the detector. As a result, the performance or signal gain of the detector is not reduced. Consequently, shifting the HED relative to the detector is shown to improve the overall performance also in negative ion mode where secondary positive particles are sent to the detector.

Rotating Relative Positions

In various embodiments, in order to shift the location where negative ions, secondary positive particles, or secondary electrons strike the entrance cone of a detector, the HED and the detector can be rotated with respect to each other. In other words, the HED can be rotated with respect to the detector, or the detector can be rotated with respect to the HED.

Figure 22:
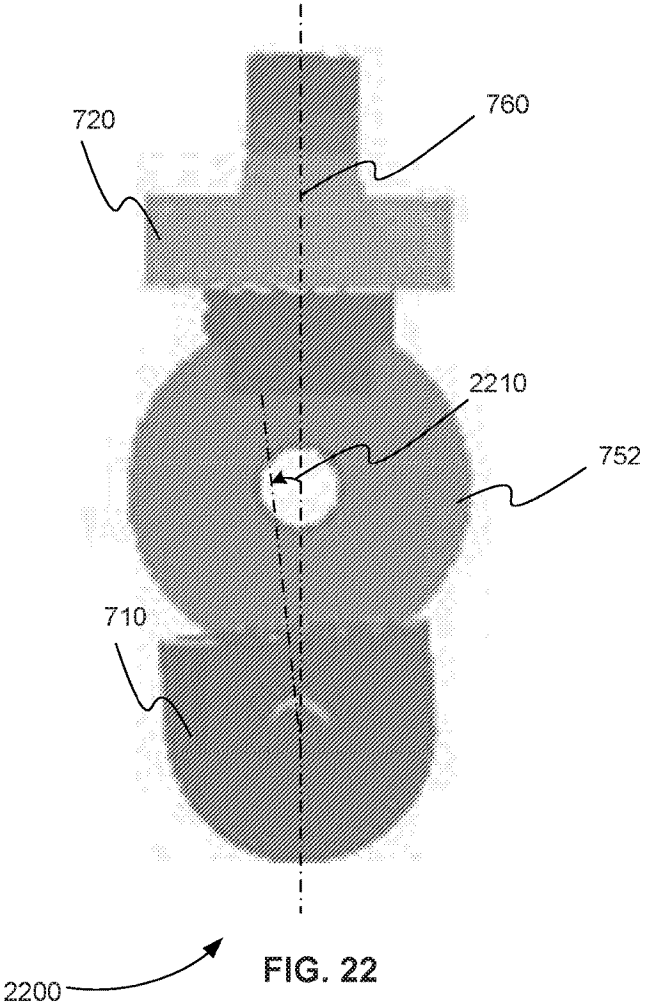
FIG. 22 is a three-dimensional view of the detector sub-system of the mass spectrometer of FIG. 7 where the position of the HED is rotated with respect to the detector, in accordance with various embodiments.

FIG. 22 is a three-dimensional view 2200 of the detector sub-system of the mass spectrometer of FIG. 7 where the position of HED 710 is rotated with respect to detector 720, in accordance with various embodiments. HED 710 is rotated, for example, 5 degrees in a plane that is parallel to the plane of second exit lens, or aperture electrode, 752. Angle 2210 depicts the rotation of HED 710 relative to formerly shared axis 660. Detector 720 remains on axis 660, but HED is now rotated from axis 660 by angle 2210.

Rotating HED 710 by 5 degrees moves the location that the particle beam (electrons for positive ion mode and small positive particles for negative ion mode) strikes the detector cone. The amount that HED 710 needs to be rotated depends upon a number of factors. One factor is the distance between the HED and the detector. The greater the distance, the less of a rotation to gain the same shift at the detector cone. Another factor is the size of the channel area in the detector. In the exemplary detector shown in FIG. 3, the channel area is about 3.5 mm in diameter. A single channel is on the order of 1 mm diameter. The degree of rotation is, therefore, governed by the size of the spot to be avoided. For example, HED 710 can be rotated so that the particle beam is moved more than 0.5 mm to avoid being directed to a single channel of detector 720.

In FIG. 22, HED 710 is rotated in a plane that is parallel to the plane of second exit lens, or aperture electrode, 752. In various embodiment HED 710 or detector 720 can be rotated in any plane to shift the location where negative ions, secondary positive particles, or secondary electrons strike the entrance cone of detector 720.

Rotating Relative Positions Simulation Data

The detector sub-system of FIG. 22 can also be simulated using Simion, for example. The potentials and parameters of Table 2 are used, for example.

Figure 23:
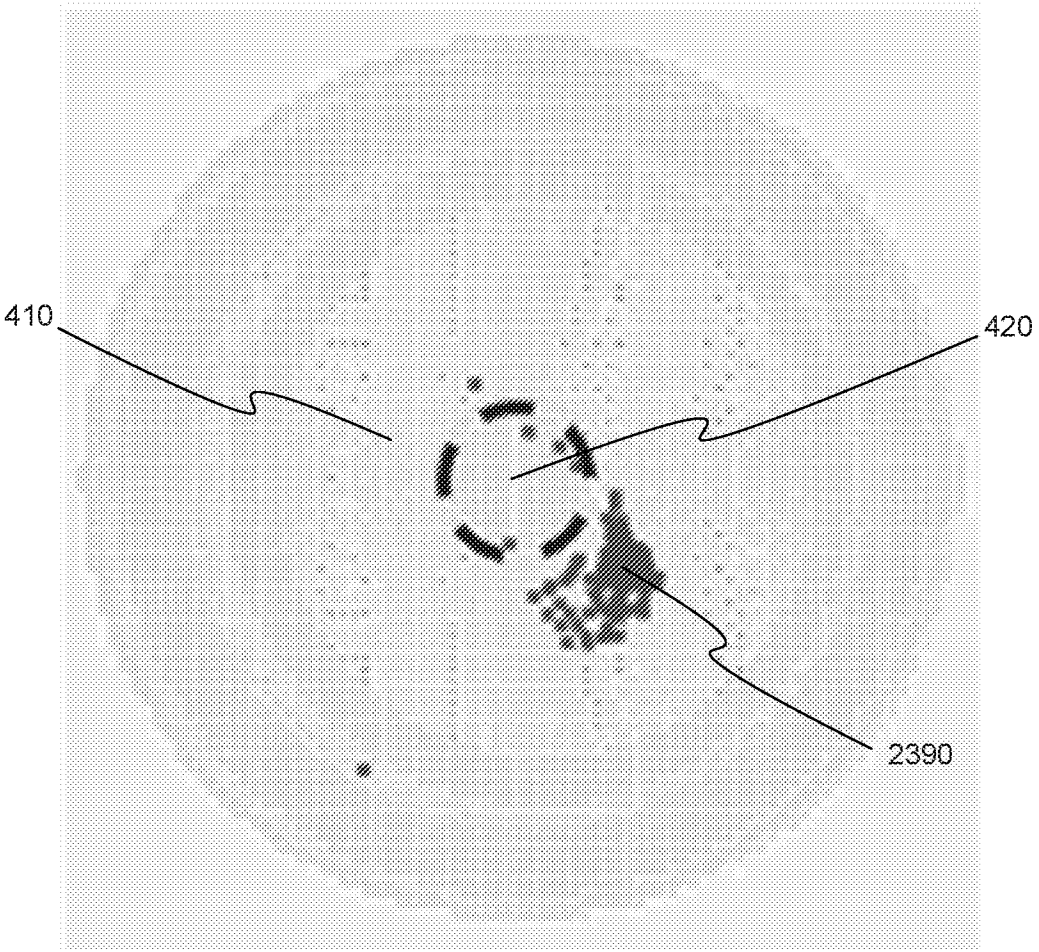
FIG. 23 is a view down into an entrance cone of a detector showing simulated termination points of ion trajectories in positive ion mode produced by simulating the detector sub-system of FIG. 22 for positive ions with an m/z of 907 and for a detector potential of 0 kV, in accordance with various embodiments.

FIG. 23 is a view 2300 down into an entrance cone of a detector showing simulated ion trajectories in positive ion mode produced by simulating the detector sub-system of FIG. 22 for positive ions with an m/z of 907 and for a detector potential of 0 kV, in accordance with various embodiments. FIG. 23 shows secondary electrons 2390 produced from positive ions with an m/z of 907 are directed primarily to collector area 410 of the entrance cone and not to channel area 420.

FIG. 23 shows that when the detector potential is 0 kV, secondary electrons of ions with an m/z of 907 are directed primarily to the collector area of the entrance cone of the detector and not to the channel area of the detector. As a result, the performance or signal gain of the detector is not reduced.

Figure 24:
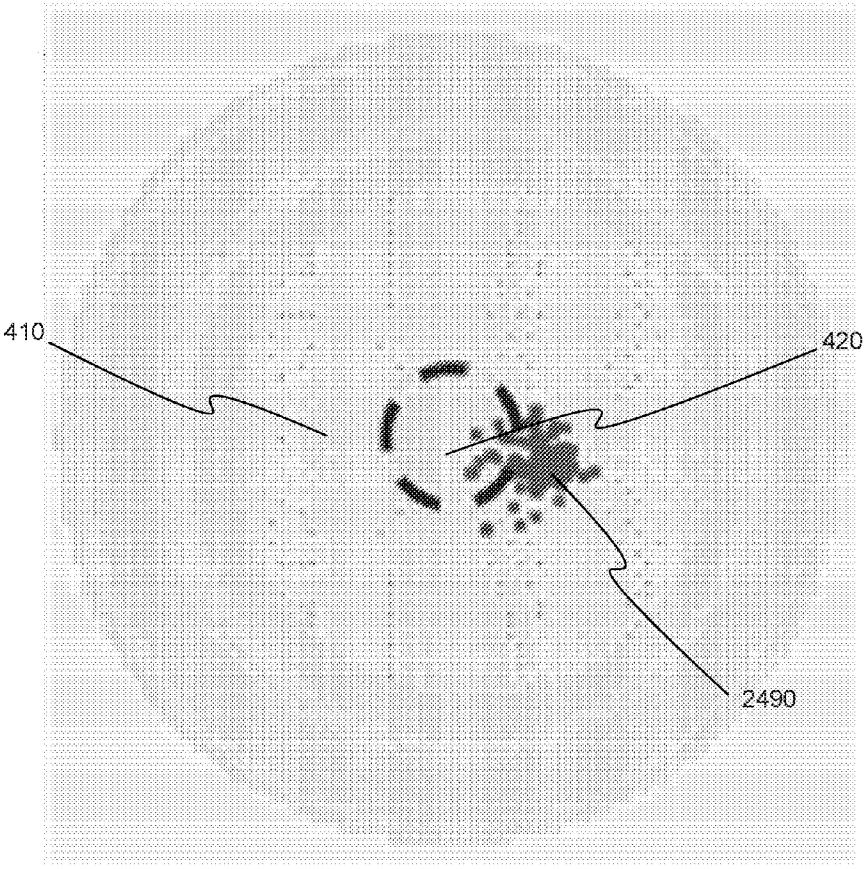
FIG. 24 is a view down into an entrance cone of a detector showing simulated termination points of ion trajectories in positive ion mode produced by simulating the detector sub-system of FIG. 22 for positive ions with an m/z of 907 and for a detector potential of +5.5 kV, in accordance with various embodiments.

FIG. 24 is a view 2400 down into an entrance cone of a detector showing simulated ion trajectories in positive ion mode produced by simulating the detector sub-system of FIG. 22 for positive ions with an m/z of 907 and for a detector potential of +5.5 kV, in accordance with various embodiments. FIG. 24 shows secondary electrons 2490 produced from positive ions with an m/z of 907 are directed primarily to collector area 410 of the entrance cone and not to channel area 420.

FIG. 24 shows that when the detector potential is +5.5 kV, ions with an m/z of 907 are primarily still directed to the collector area of the entrance cone of the detector. As a result, the performance or signal gain of the detector is not significantly reduced. There is a small reduction because a fraction of the particles still strike the channel area. Still, it is much better than without the rotation. Consequently, rotating the HED relative to the detector is shown to improve the overall performance.

Adding an Electrode

In various embodiments, in order to shift the location where negative ions, secondary positive particles, or secondary electrons strike the entrance cone of a detector, an additional electrode can be placed in proximity with the HED and the detector. The additional electrode shifts the location where negative ions, secondary positive particles, or secondary electrons strike the entrance cone of a detector by affecting the electric field between HED and the detector.

Figure 25:
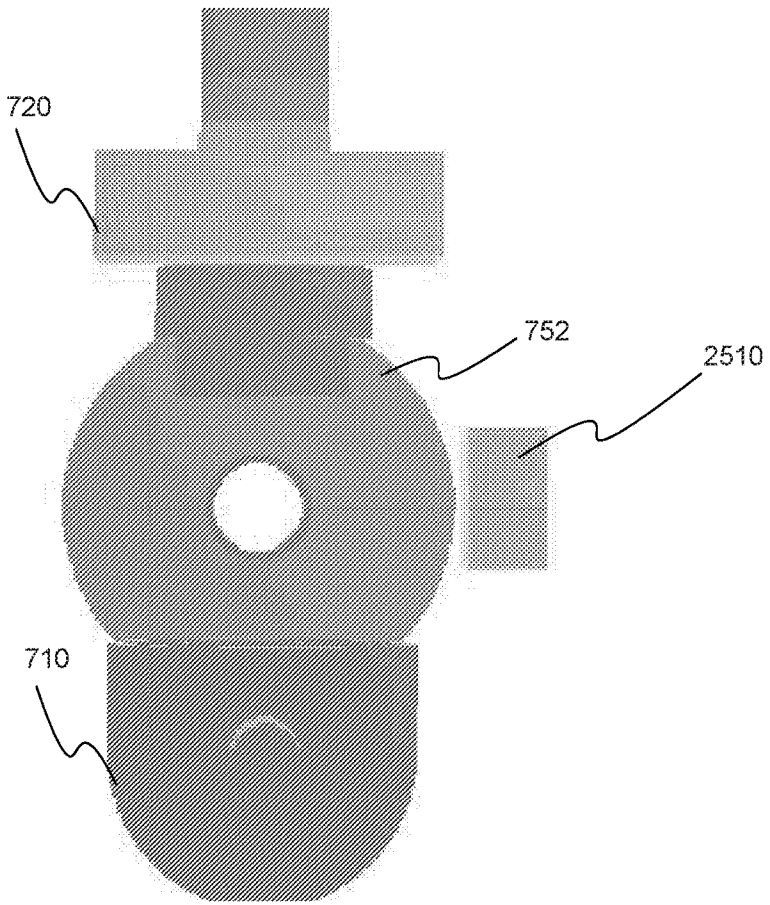
FIG. 25 is a three-dimensional view of the detector sub-system of the mass spectrometer of FIG. 7 where an additional electrode 2510 is added near the HED and the detector, in accordance with various embodiments.

FIG. 25 is a three-dimensional view 2500 of the detector sub-system of the mass spectrometer of FIG. 7 where an additional electrode 2510 is added near HED 710 and detector 720, in accordance with various embodiments. FIG. 25 shows the position of additional electrode 2510, HED 710, and detector 720 in a plane that is parallel to the plane of second exit lens, or aperture electrode, 752.

Additional electrode 2510 can have a number of different shapes. Additional electrode 2510 affects the negative ions, secondary positive particles, or secondary electrons before they strike the entrance cone of detector 720. A potential can be applied to additional electrode 2510 in order to ensure that particles only impact the collector area of detector 720. The applied potential must be enough to cause a shift in trajectories. Additional electrode 2510 is shown in FIG. 25 in between and on one side of HED 710 and detector 720. Additional electrode 2510 can, however, be placed in many other locations proximate to HED 710 and detector 720. Additional electrode 2510 is also shown in FIG. 25 as one independent electrode. In various embodiments, one or more electrodes can be used to affects the negative ions, secondary positive particles, or secondary electrons before they strike the entrance cone of detector 720. The one or more electrodes can also be part of the chamber enclosing the detector sub-system.

Adding an Electrode Simulation Data

The detector sub-system of FIG. 25 can also be simulated using Simion, for example. The potentials and parameters of Table 2 are used, for example. The potential applied to the additional electrode is made to be the same as the potential applied to the detector. This allows the same power supply for both the additional electrode and the detector, for example.

Figure 26:
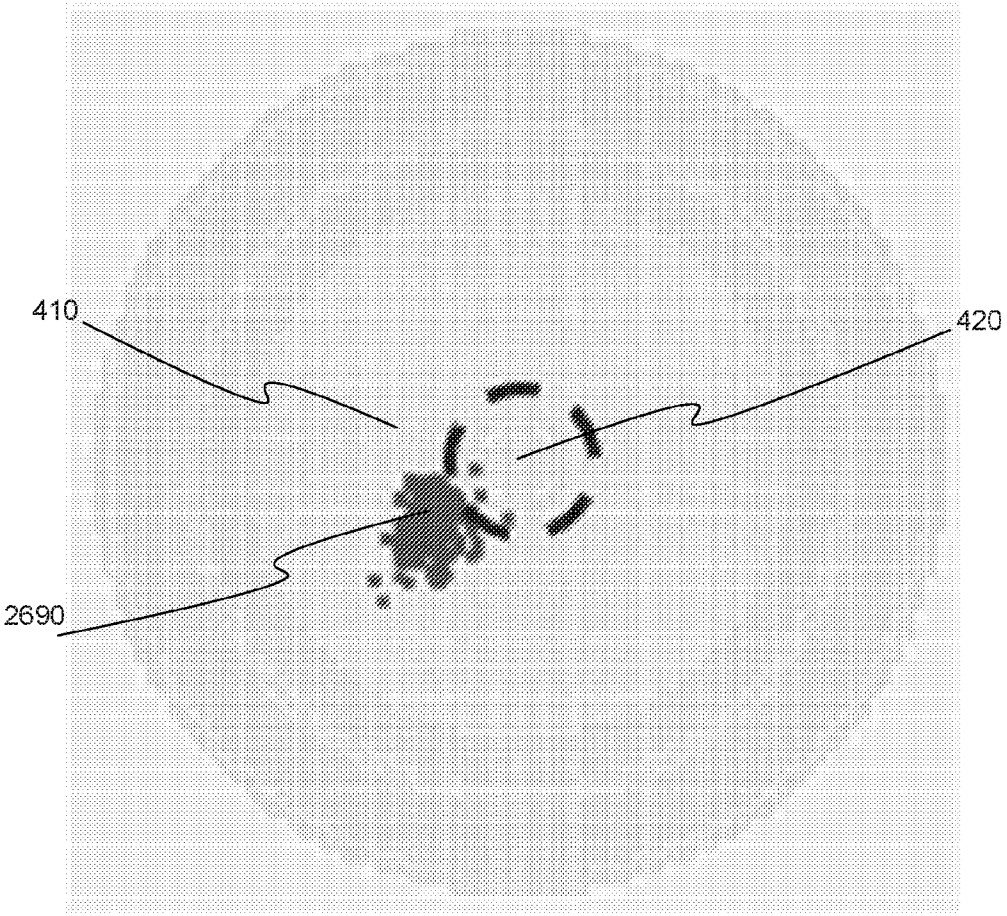
FIG. 26 is a view down into an entrance cone of a detector showing simulated termination points of ion trajectories in positive ion mode produced by simulating the detector sub-system of FIG. 25 for positive ions with an m/z of 907 and for a detector potential of 0 kV, in accordance with various embodiments.

FIG. 26 is a view 2600 down into an entrance cone of a detector showing simulated ion trajectories in positive ion mode produced by simulating the detector sub-system of FIG. 25 for positive ions with an m/z of 907 and for a detector potential of 0 kV, in accordance with various embodiments. FIG. 26 shows secondary electrons 2690 produced from positive ions with an m/z of 907 are directed primarily to collector area 410 of the entrance cone and not to channel area 420.

FIG. 26 shows that when the detector potential is 0 kV, ions with an m/z of 907 are directed primarily to the collector area of the entrance cone of the detector and not to the channel area of the detector. As a result, the performance or signal gain of the detector is not reduced.

Figure 27:
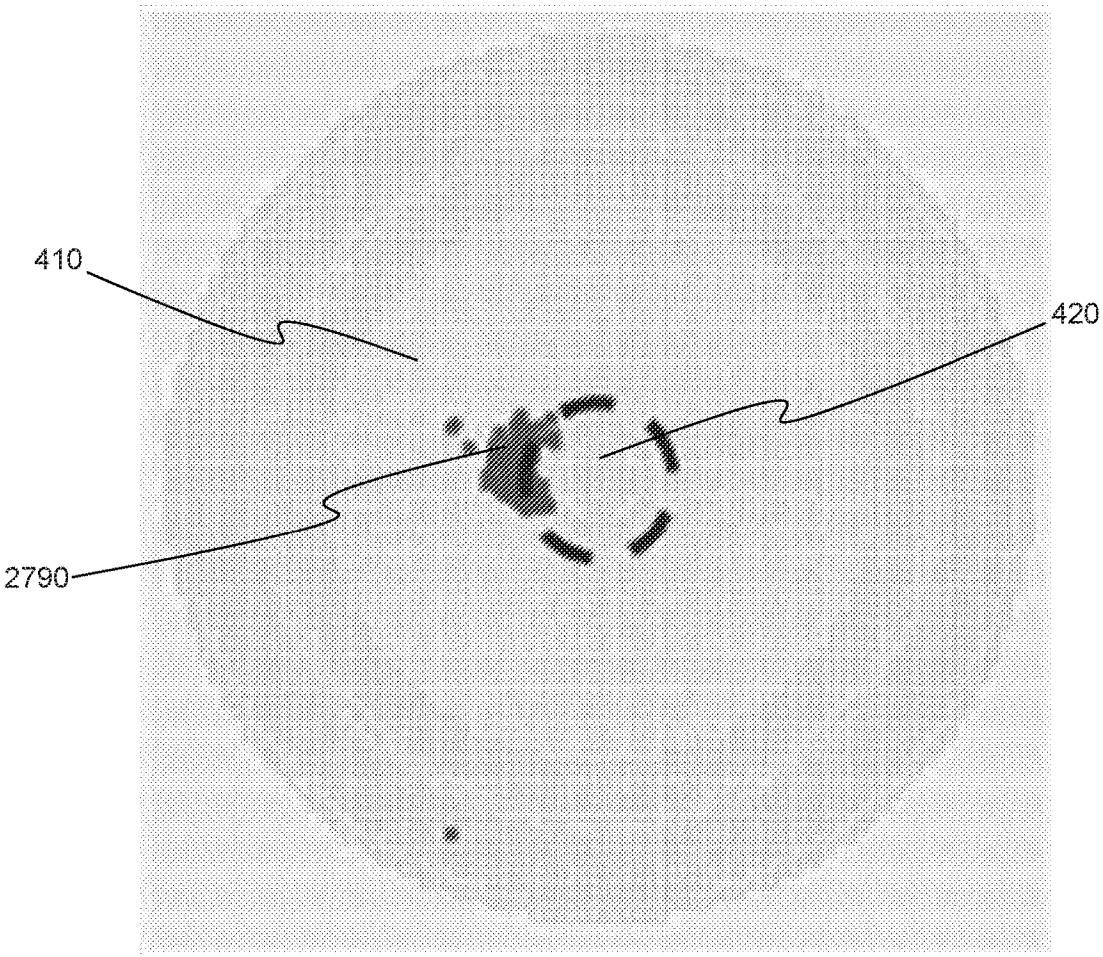
FIG. 27 is a view down into an entrance cone of a detector showing simulated termination points of ion trajectories in positive ion mode produced by simulating the detector sub-system of FIG. 25 for positive ions with an m/z of 907 and for a detector potential of +5.5 kV, in accordance with various embodiments.

FIG. 27 is a view 2700 down into an entrance cone of a detector showing simulated ion trajectories in positive ion mode produced by simulating the detector sub-system of FIG. 25 for positive ions with an m/z of 907 and for a detector potential of +5.5 kV, in accordance with various embodiments. FIG. 27 shows secondary electrons 2790 produced from positive ions with an m/z of 907 are directed primarily to collector area 410 of the entrance cone and not to channel area 420.

FIG. 27 shows that when the detector potential is +5.5 kV, ions with an m/z of 907 are primarily still directed to the collector area of the entrance cone of the detector. As a result, the performance or signal gain of the detector is not reduced. Consequently, placing an additional electrode near the HED and the detector is shown to improve the overall performance.

Additional Dynodes

FIGS. 7, 8, 11, 12, 15, 16, 20, 21, 22, and 25 all show the use of one HED or dynode. In various embodiments, two or more dynodes can be used.

Figure 28:
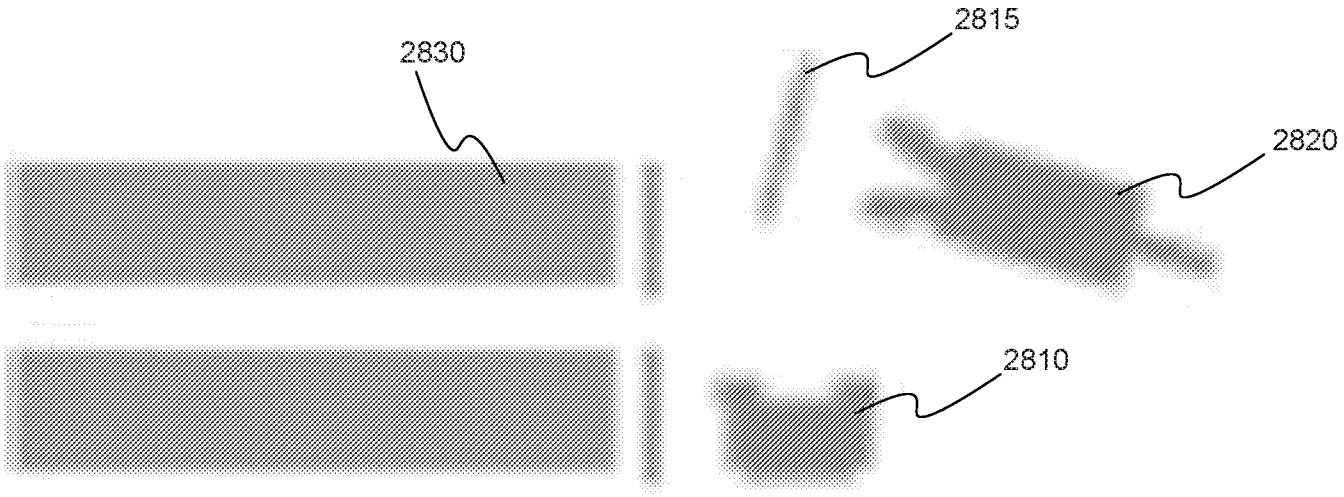
FIG. 28 is a side view of a detector sub-system that includes two dynodes, in accordance with various embodiments.

FIG. 28 is a side view 2800 of a detector sub-system that includes two dynodes, in accordance with various embodiments. The detector sub-system includes first dynode 2810, second matching dynode 2815, and electron multiplier or detector 2820. Ions from quadrupoles 2830, for example, strike first dynode 2810. Secondary particles from first dynode 2810 are directed to second matching dynode 2815. When the secondary particles strike second matching dynode 2815, second matching dynode 2815 produces tertiary particles that then go to detector 2820. Any of the embodiments described above to shift the location where secondary positive particles, or secondary electrons strike the entrance cone of a detector can be applied to the detector sub-system of FIG. 28. For example, one or more of first dynode 2810, second matching dynode 2815, and detector 2820 can be shifted or rotated. In addition, an electrode may be added to the detector sub-system of FIG. 28.

System for Directing Ions Directly to an Electron Multiplier

Figure 29:
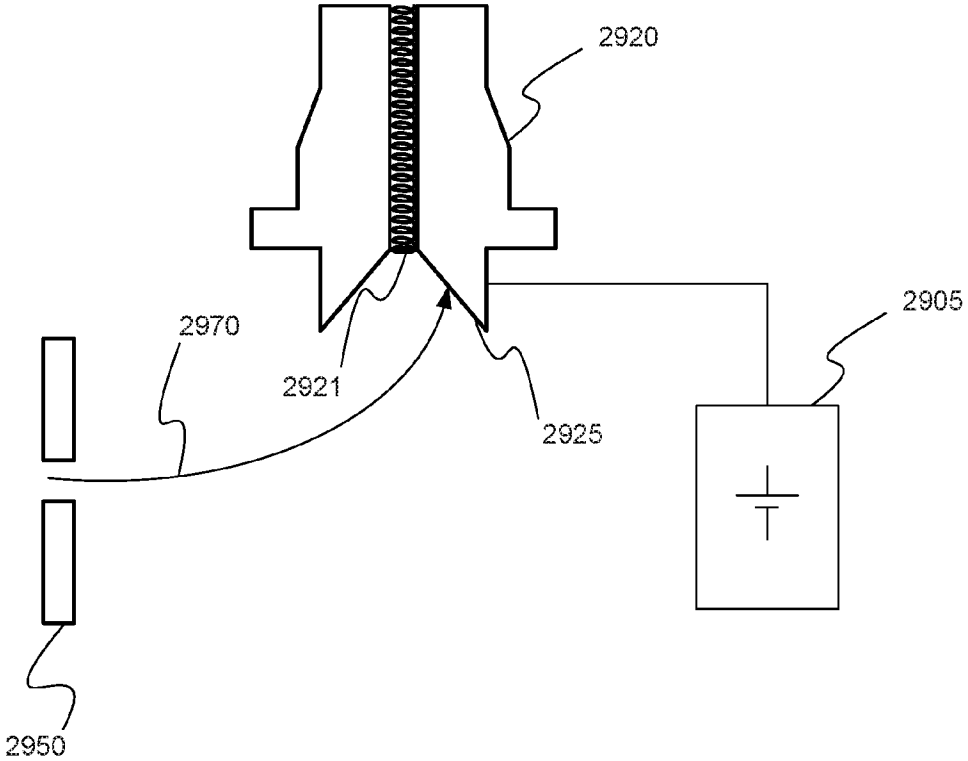
FIG. 29 is a schematic diagram of a mass spectrometer detector sub-system that directs ions directly from an exit lens of a mass spectrometer to the collector area of an electron multiplier and away from the channel area of the electron multiplier for a range of voltages that are applied to the electron multiplier, in accordance with various embodiments.

FIG. 29 is a schematic diagram 2900 of a mass spectrometer detector sub-system that directs ions directly from an exit lens of a mass spectrometer to the collector area of an electron multiplier and away from the channel area of the electron multiplier for a range of voltages that are applied to the electron multiplier, in accordance with various embodiments. The detector sub-system of FIG. 29 includes detector or electron multiplier 2920 and at least one voltage source 2905. At least one voltage source 2905 is in electrical contact with electron multiplier 2920.

Electron multiplier 2920 includes an aperture with an entrance cone. The walls of the entrance cone comprise collector area 2925 and an apex of the entrance cone comprises channel area 2921. At least one voltage source 2905 applies an electron multiplier voltage of a range of electron multiplier voltages to electron multiplier 2920.

Electron multiplier 2920 is positioned relative to exit lens 2950 of a mass spectrometer to direct an ion beam directly from exit lens 2950 to collector area 2925 of electron multiplier 2920 and not to channel area 2921 of electron multiplier 2920 for the range of electron multiplier voltages applied by at least one voltage source 2905 to electron multiplier 2920. Path 2970 shows the trajectory of the ion beam. Exit lens 2950 can be, but is not limited to, an exit lens of a quadrupole or an exit lens of an ion trap. An exit lens voltage is also applied to exit lens 2950.

In various embodiments, the mass spectrometer detector sub-system of FIG. 29 is operated in negative ion mode. The ion beam comprises negative ions with an ion energy of at least 2 keV, and the range of electron multiplier voltages comprises 0 kV to at least +5.5 kV, for example.

In various embodiments, the mass spectrometer detector sub-system of FIG. 29 further includes a processor (not shown). The processor can be, but is not limited to, a computer, microprocessor, or any device capable of sending and receiving control signals and data to and from the mass spectrometer detector sub-system of FIG. 29 and processing data. The processor can be, for example, computer system 100 of FIG. 1. The processor can, for example, select the electron multiplier voltage of the range of electron multiplier voltages that at least one voltage source 2905 applies to electron multiplier 2920.

Method for Directing Ions Directly to an Electron Multiplier

Figure 30:
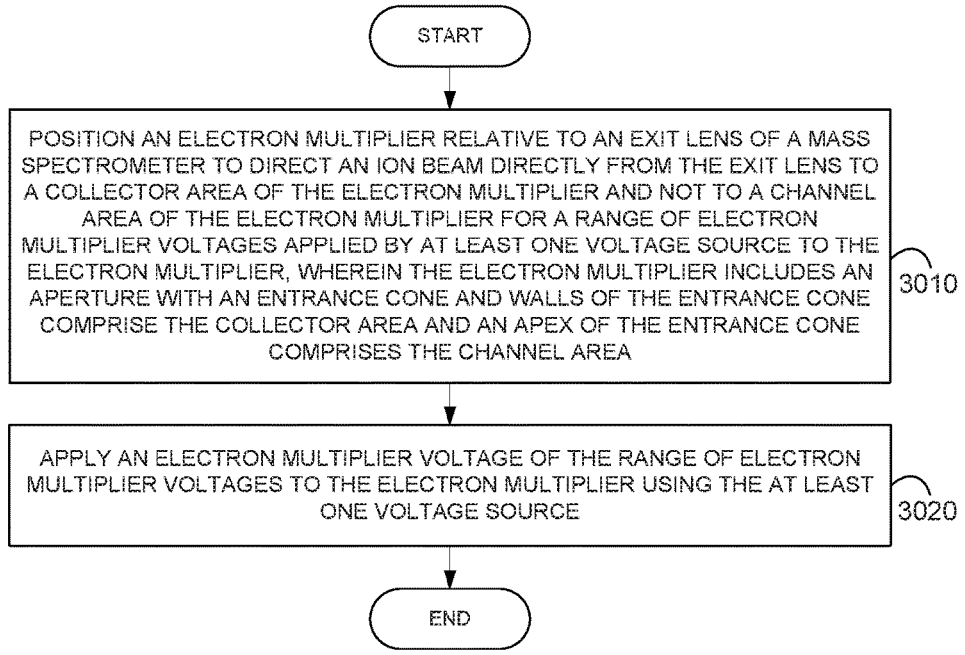
FIG. 30 is a flowchart showing a method for directing ions directly from an exit lens of a mass spectrometer to the collector area of an electron multiplier and away from the channel area of the electron multiplier for a range of voltages that are applied to the electron multiplier, in accordance with various embodiments.
Figure 30:
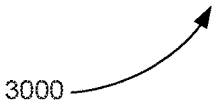

FIG. 30 is a flowchart showing a method 3000 for directing ions directly from an exit lens of a mass spectrometer to the collector area of an electron multiplier and away from the channel area of the electron multiplier for a range of voltages that are applied to the electron multiplier, in accordance with various embodiments.

In step 3010 of method 3000, an electron multiplier is positioned relative to an exit lens of a mass spectrometer to direct an ion beam directly from the exit lens to a collector area of the electron multiplier and not to a channel area of the electron multiplier for a range of electron multiplier voltages applied by at least one voltage source to the electron multiplier. The electron multiplier includes an aperture with an entrance cone. Walls of the entrance cone comprise the collector area and an apex of the entrance cone comprises the channel area.

In step 3020, an electron multiplier voltage of the range of electron multiplier voltages is applied to the electron multiplier using the at least one voltage source.

In various embodiments, the mass spectrometer detector sub-system is operated in negative ion mode, the ion beam comprises negative ions with an ion energy of at least 2 keV, and the range of electron multiplier voltages comprises 0 kV to at least +5.5 kV.

System for Directing Secondary Particles Produced by a Dynode

Figure 31:
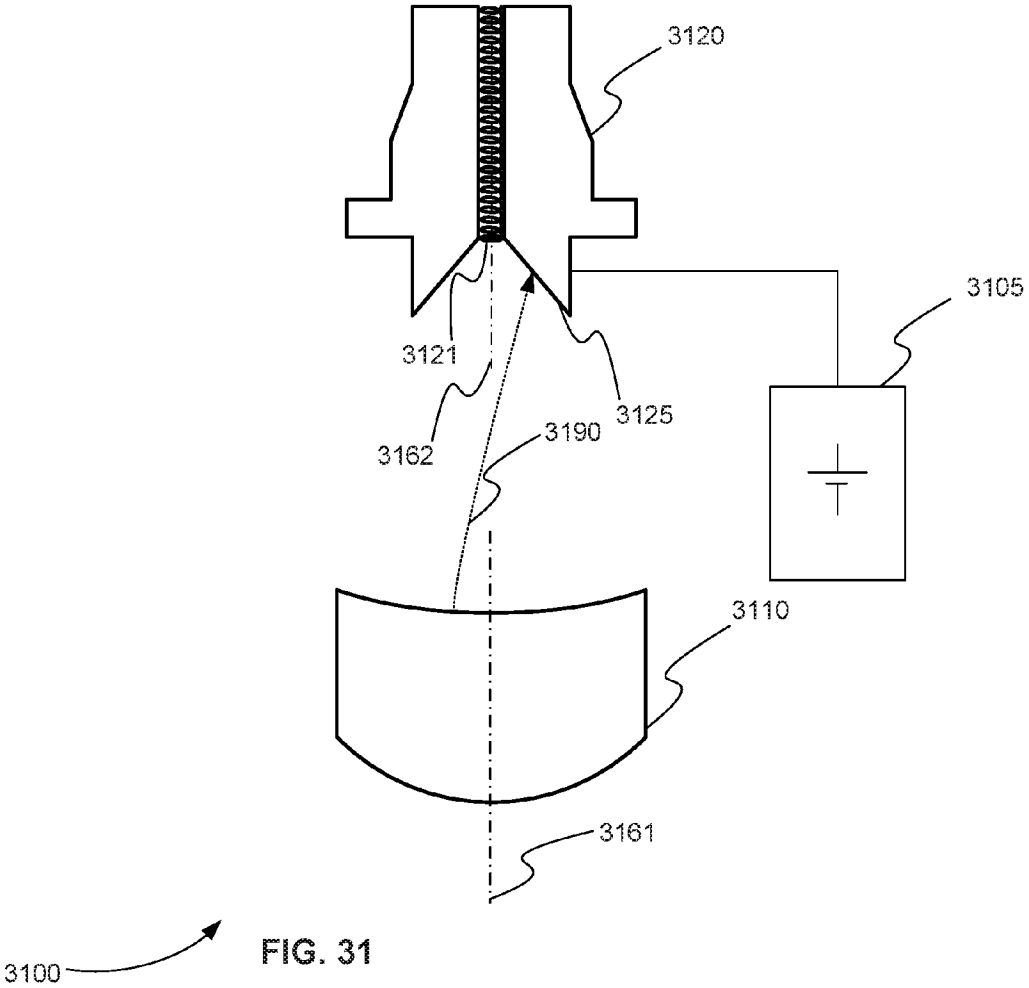
FIG. 31 is a schematic diagram of a mass spectrometer detector sub-system that directs secondary particles produced by a dynode to the collector area of an electron multiplier and away from the channel area of the electron multiplier for a range of voltages that are applied to the electron multiplier, in accordance with various embodiments.

FIG. 31 is a schematic diagram 3100 of a mass spectrometer detector sub-system that directs secondary particles produced by a dynode to the collector area of an electron multiplier and away from the channel area of the electron multiplier for a range of voltages that are applied to the electron multiplier, in accordance with various embodiments. The detector sub-system of FIG. 31 includes detector or electron multiplier 3120, at least one dynode 3110, and one or more voltage sources 3105. One or more voltage sources 3105 apply an electron multiplier voltage of a range of electron multiplier voltages to electron multiplier 3120 and a dynode voltage to at least one dynode 3110. One or more voltage sources 3105 are in electrical contact with electron multiplier 3120 and at least one dynode 3110. In various embodiments, at least one dynode 3110 is the last dynode (2815 of FIG. 28) of two or more dynodes.

In FIG. 31, electron multiplier 3120 includes an aperture with an entrance cone. Walls of the entrance cone comprise collector area 3125 and an apex of the entrance cone comprises channel area 3121. Electron multiplier 3120 is positioned relative to at least one dynode 3110 to direct a beam of secondary particles from at least one dynode 3110 to collector area 3125 of electron multiplier 3120 and not to channel area 3121 of electron multiplier 3120 for the range of electron multiplier voltages applied by one or more voltage sources 3105 to electron multiplier 3120 and for the voltage applied by one or more voltage sources 3105 to at least one dynode 3110.

In various embodiments, the mass spectrometer detector sub-system of FIG. 31 further includes a processor (not shown). The processor can be, but is not limited to, a computer, microprocessor, or any device capable of sending and receiving control signals and data to and from the mass spectrometer detector sub-system of FIG. 31 and processing data. The processor can be, for example, computer system 100 of FIG. 1. The processor can, for example, select the electron multiplier voltage of the range of electron multiplier voltages that one or more voltage sources 3105 apply to electron multiplier 3120.

In various embodiments, electron multiplier 3120 is positioned relative to at least one dynode 3120 so that first axis 3162 of electron multiplier 3120 and second axis 3161 of at least one dynode 3110 are parallel, but are shifted by an incremental distance. The incremental distance ensures that beam of secondary particles 3190 is directed from at least one dynode 3110 to collector area 3125 of electron multiplier 3120 and not to channel area 3121 of electron multiplier 3120 for the range of electron multiplier voltages. The incremental distance can be 3 mm, for example.

In various embodiments, electron multiplier 3120 is positioned relative to at least one dynode 3110 so that first axis 3162 of electron multiplier 3120 and second axis 3161 of at least one dynode 3110 intersect at an incremental angle. The incremental angle ensures that beam of secondary particles 3190 is directed from at least one dynode 3110 to collector area 3125 of electron multiplier 3120 and not to channel area 3121 of electron multiplier 3120 for the range of electron multiplier voltages.

In various embodiments, the detector sub-system of FIG. 31 further includes one or more additional electrodes (not shown) that receive electrode voltages from one or more voltage sources 3105. Electron multiplier 3120 is positioned relative to at least one dynode 3110 so that a path between electron multiplier 3120 and at least one dynode 3110 is proximate the one or more additional electrodes. The electrode voltages of the one or more additional electrodes ensures that beam 3190 of secondary particles is directed from at least one dynode 3110 to collector area 3125 of electron multiplier 3120 and not to channel area 3121 of electron multiplier 3120 for the range of electron multiplier voltages.

In various embodiments, when the detector sub-system of FIG. 31 is operated in positive ion mode, the dynode voltage is more negative than the range of electron multiplier voltages, positive ions are directed from an exit lens (not shown) of a mass spectrometer to at least one dynode 3110, at least one dynode 3110 converts the positive ions to beam 3190 of secondary particles, and beam 3190 of secondary particles is directed from at least one dynode 3110 to collector area 3125 of the electron multiplier 3120 and not to channel area 3121 of electron multiplier 3120 for the range of electron multiplier voltages.

In various embodiments, when the detector sub-system of FIG. 31 is operated in negative ion mode, the dynode voltage is more negative than the range of electron multiplier voltages, negative ions are directed from an exit lens (not shown) of a mass spectrometer directly to collector area 3125 of electron multiplier 3120 and not to channel area 3121 of electron multiplier 3120 for the range of electron multiplier voltages. The negative ions are directed from the exit lens of the mass spectrometer directly to electron multiplier 3120 with an ion energy of at least 2 keV, and the range of electron multiplier voltages comprises 0 kV to at least +5.5 kV, for example.

Method for Directing Secondary Particles Produced by a Dynode

Figure 32:
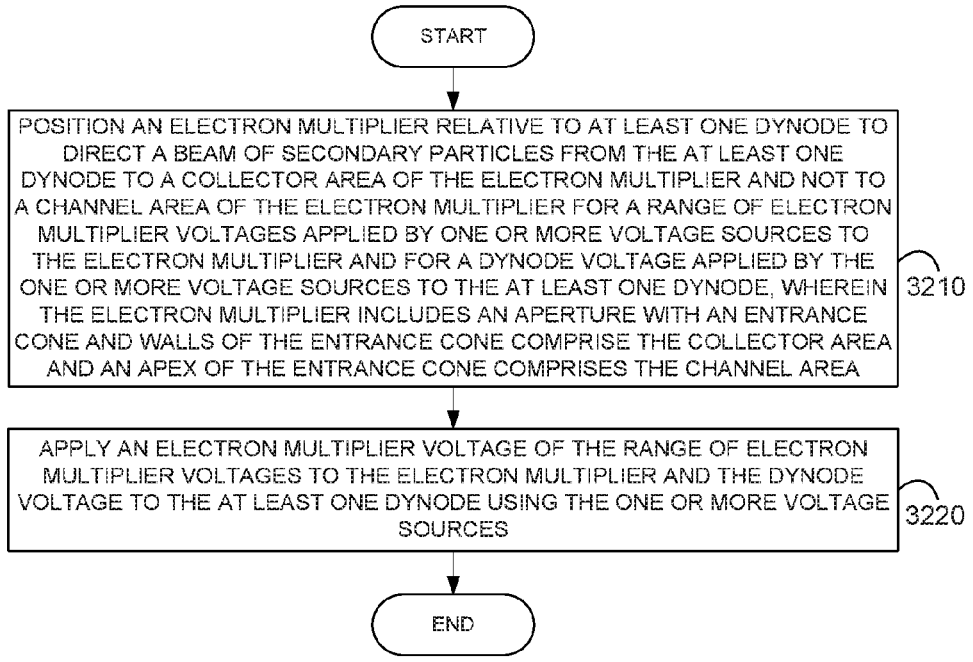
FIG. 32 is a flowchart showing a method for directing secondary particles produced by a dynode to the collector area of an electron multiplier and away from the channel area of the electron multiplier for a range of voltages that are applied to the electron multiplier, in accordance with various embodiments.

FIG. 32 is a flowchart showing a method 3200 for directing secondary particles produced by a dynode to the collector area of an electron multiplier and away from the channel area of the electron multiplier for a range of voltages that are applied to the electron multiplier, in accordance with various embodiments.

In step 3210 of method 3200, an electron multiplier is positioned relative to at least one dynode to direct a beam of secondary particles from the at least one dynode to a collector area of the electron multiplier and not to a channel area of the electron multiplier for a range of electron multiplier voltages applied by one or more voltage sources to the electron multiplier and for a dynode voltage applied by the one or more voltage sources to the at least one dynode. The electron multiplier includes an aperture with an entrance cone. Walls of the entrance cone comprise the collector area and an apex of the entrance cone comprises the channel area.

In step 3220, an electron multiplier voltage of the range of electron multiplier voltages is applied to the electron multiplier and the dynode voltage is applied to the at least one dynode using the one or more voltage sources.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A method for directing secondary particles produced by a dynode to the collector area of an electron multiplier and away from the channel area of the electron multiplier for a range of voltages that are applied to the electron multiplier, comprising:

positioning an electron multiplier relative to at least one dynode to direct a beam of secondary particles from the at least one dynode to a collector area of the electron multiplier and not to a channel area of the electron multiplier for a range of electron multiplier voltages applied by one or more voltage sources to the electron multiplier and for a dynode voltage applied by the one or more voltage sources to the at least one dynode, wherein the electron multiplier includes an aperture with an entrance cone, and wherein walls of the entrance cone comprise the collector area and an apex of the entrance cone comprises the channel area; and applying an electron multiplier voltage of the range of electron multiplier voltages to the electron multiplier and the dynode voltage to the at least one dynode, using the one or more voltage sources.

2. The method of claim 1, wherein when operated in negative ion mode, the ion beam comprises negative ions with an ion energy of at least 2 keV, and the range of electron multiplier voltages comprises 0 kV to at least +5.5 kV.

3. A mass spectrometer detector sub-system that directs secondary particles produced by a dynode to the collector area of an electron multiplier and away from the channel area of the electron multiplier for a range of voltages that are applied to the electron multiplier, comprising:

an electron multiplier that includes an aperture with an entrance cone, wherein walls of the entrance cone comprise a collector area and an apex of the entrance cone comprises a channel area;

at least one dynode; and one or more voltage sources that apply an electron multiplier voltage of a range of electron multiplier voltages to the electron multiplier and a dynode voltage to the at least one dynode, wherein the electron multiplier is positioned relative to the at least one dynode to direct a beam of secondary particles from the at least one dynode to the collector area of the electron multiplier and not to the channel area of the electron multiplier for the range of electron multiplier voltages applied by the one or more voltage sources to the electron multiplier and for the dynode voltage applied by the one or more voltage sources to the at least one dynode.

4. The mass spectrometer detector sub-system of claim 3, wherein the electron multiplier is positioned relative to the at least one dynode so that a first axis of the electron multiplier and a second axis of the at least one dynode are parallel, but are shifted by an incremental distance, and the incremental distance ensures that the beam of secondary particles is directed from the at least one dynode to the collector area of the electron multiplier and not to the channel area of the electron multiplier for the range of electron multiplier voltages.

5. The mass spectrometer detector sub-system of claim 4, wherein the incremental distance comprises 3 mm.

6. The mass spectrometer detector sub-system of claim 3, wherein the electron multiplier is positioned relative to the at least one dynode so that a first axis of the electron multiplier and a second axis of the at least one dynode intersect at an incremental angle, and the incremental angle ensures that the beam of secondary particles is directed from the at least one dynode to the collector area of the electron multiplier and not to the channel area of the electron multiplier for the range of electron multiplier voltages.

7. The mass spectrometer detector sub-system of claim 3, further comprising one or more additional electrodes that receive electrode voltages from the one or more voltage sources, wherein the electron multiplier is positioned relative to the at least one dynode so that a path between the electron multiplier and the at least one dynode is proximate the one or more additional electrodes, and the electrode voltages of the one or more additional electrodes ensures that the beam of secondary particles is directed from the at least one dynode to the collector area of the electron multiplier and not to the channel area of the electron multiplier for the range of electron multiplier voltages.

8. The mass spectrometer detector sub-system of claim 3, wherein when the detector sub-system is operated in positive ion mode, the dynode voltage is more negative than the range of electron multiplier voltages, positive ions are directed from an exit lens of a mass spectrometer to the at least one dynode, the at least one dynode converts the positive ions to the beam of secondary particles, and the beam of secondary particles is directed from the at least one dynode to the collector area of the electron multiplier and not to the channel area of the electron multiplier for the range of electron multiplier voltages.

9. The mass spectrometer detector sub-system of claim 3, wherein when the detector sub-system is operated in negative ion mode, the dynode voltage is more negative than the range of electron multiplier voltages, negative ions are directed from an exit lens of a mass spectrometer directly to the collector area of the electron multiplier and not to the channel area of the electron multiplier for the range of electron multiplier voltages.

10. The mass spectrometer detector sub-system of claim 9, wherein the negative ions are directed from the exit lens of a mass spectrometer directly to the electron multiplier with an ion energy of at least 2 keV, and the range of electron multiplier voltages comprises 0 kV to at least +5.5 kV.

* * * * *